US010212982B2

(12) United States Patent
Nimura

(10) Patent No.: US 10,212,982 B2
(45) Date of Patent: Feb. 26, 2019

(54) HELMET

(75) Inventor: Taku Nimura, Ibaraki (JP)

(73) Assignee: SHOEI CO., LTD., Tokyo (JP)

( * ) Notice: Subject to any disclaimer, the term of this patent is extended or adjusted under 35 U.S.C. 154(b) by 269 days.

(21) Appl. No.: 13/588,040

(22) Filed: Aug. 17, 2012

(65) Prior Publication Data

US 2013/0081199 A1 Apr. 4, 2013

(30) Foreign Application Priority Data

Oct. 3, 2011 (JP) ..... 2011-219240

(51) Int. Cl.
*A42B 3/22* (2006.01)
*A42B 3/32* (2006.01)

(52) U.S. Cl.
CPC ..... *A42B 3/221* (2013.01); *A42B 3/22* (2013.01); *A42B 3/222* (2013.01); *A42B 3/326* (2013.01)

(58) Field of Classification Search
CPC .. A42B 3/08; A42B 3/22; A42B 3/221; A42B 3/223; A42B 3/222; A42B 3/228
USPC ..... 2/421, 424, 425, 6.3–6.5, 6.7
See application file for complete search history.

(56) References Cited

U.S. PATENT DOCUMENTS 4,769,857 A * 9/1988 Cianfanelli et al. ..... 2/424
6,047,409 A * 4/2000 Simpson ..... A42B 3/223 2/424
6,249,918 B1 * 6/2001 Lacroix ..... 2/424
6,622,314 B1 * 9/2003 Kim ..... A42B 3/222 2/424
6,644,308 B2 * 11/2003 Kalhok et al. ..... 128/201.24
2005/0015861 A1 * 1/2005 Gafforio et al. ..... 2/424
2005/0273912 A1 * 12/2005 Gafforio ..... A42B 3/226 2/424
2006/0064799 A1 * 3/2006 Dion ..... A42B 3/326 2/424
2007/0136934 A1 * 6/2007 Kim et al. ..... 2/424
2007/0226880 A1 * 10/2007 Shida ..... 2/410
2008/0196148 A1 * 8/2008 Morin ..... 2/421
2008/0216215 A1 * 9/2008 Lee ..... 2/424
2009/0100576 A1 * 4/2009 Kim ..... 2/424
2010/0132097 A1 * 6/2010 Chen ..... A42B 3/226 2/425
2011/0078846 A1 * 4/2011 Gafforio et al. ..... 2/424
2011/0302701 A1 * 12/2011 Kuo ..... 2/421
(Continued)

*Primary Examiner* — Megan E Lynch
(74) *Attorney, Agent, or Firm* — SOLARIS Intellectual Property Group, PLLC

(57) ABSTRACT

A chin guard support mechanism includes first and second fixed-side members, and a moving-side member fixed to the chin guard. When the chin guard pivots forward from a down position in a rising direction, an annular following surface provided on the moving-side member pivots forward while following an annular followed surface provided on the second fixed-side member to make the chin guard rise while moving forward. It is possible to provide a helmet that allows the chin guard support mechanism capable of relatively excellently raising/lowering the chin guard to have a simple structure, allows to operate the chin guard support mechanism smoothly, obviates the necessity of making the structure in a region including an end of the chin guard including the chin guard support mechanism and a vicinity thereof bulky, and obviates the necessity of making the widthwise size of the helmet large.

9 Claims, 21 Drawing Sheets

(56) References Cited

U.S. PATENT DOCUMENTS

2012/0144566 A1* 6/2012 Hunt ..... A42B 3/223
2/422

* cited by examiner

HELMET

TECHNICAL FIELD

The present invention relates to a helmet including left and right chin guard support mechanisms provided on a main cap body, and a chin guard whose regions including left and right ends and vicinities thereof are pivotally attached to the left and right chin guard support mechanisms, respectively.

BACKGROUND OF THE INVENTION

A helmet configured as described above is conventionally known, as disclosed in US 2009/0100576 A1. In the helmet (to be referred to as "the conventional helmet" hereinafter) disclosed in US 2009/0100576 A1, each of the left and right chin guard support mechanisms includes a fixed-side unit fixed to the left side surface or right side surface of the main cap body, and a pivotal-side unit fixed to a region including the left or right end of the chin guard and a vicinity thereof. The fixed-side unit is provided with a first longitudinal guide hole that extends forward obliquely above, and a second longitudinal guide hole that is arranged under the first longitudinal guide hole and extends forward obliquely below. The longitudinal direction of the first longitudinal guide hole is substantially perpendicular to that of the second longitudinal guide hole. The first and second longitudinal guide holes extend substantially linearly. The pivotal-side unit is provided with a first connection portion that is inserted into the first longitudinal guide hole and guided by the first longitudinal guide hole, and a second connection portion that is inserted into the second longitudinal guide hole and guided by the second longitudinal guide hole.

In the conventional helmet configured as described above, when the chin guard moves from the lowermost position to the uppermost position, the second connection portion moves from the upper end side of the second longitudinal guide hole to its lower end side. At the same time, the first connection portion moves from the lower end side of the first longitudinal guide hole to its upper end side and then from the upper end side to the lower end side. Hence, during the movement from the lowermost position to the midpoint of rise, the chin guard slightly moves forward, too. In addition, during the rise from the midpoint of rise to the uppermost position, the chin guard slightly moves backward, too. When lowering from the uppermost position to the lowermost position contrary to the rise, the chin guard slightly moves forward and then slightly moves backward, as in the rise.

However, in the left or right chin guard support mechanism of the conventional helmet, the fixed-side unit having the first and second longitudinal guide holes, and the pivotal-side unit including the first and second connection portions need to be provided between the left side surface or the right side surface of the main cap body and a region including the left or right ends of the chin guard and a vicinity thereof. For this reason, the structure of each chin guard support mechanism is relatively complex, and it may be difficult to smoothly operate the chin guard support mechanisms. In addition, a space to provide the fixed-side unit and the pivotal-side unit is necessary on the left or right side surface of the main cap body and the region including the left or right ends of the chin guard and the vicinity thereof. For this reason, the structure in a region including the end of the chin guard including the left or right chin guard support mechanism and a vicinity thereof may be bulky, and the widthwise size of the helmet including the left and right chin guard support mechanisms may be large.

SUMMARY OF THE INVENTION

The present invention is aimed at properly solving the above-described problems of the conventional helmet using a relatively simple arrangement.

The present invention therefore has an object to provide a helmet that allows a chin guard support mechanism capable of relatively excellently raising/lowering a chin guard to have a relatively simple structure, allows to operate the chin guard support mechanism relatively smoothly, obviates the necessity of making the structure in a region including an end of the chin guard including the chin guard support mechanism and a vicinity thereof particularly bulky, and obviates the necessity of making the widthwise size of the helmet including the left chin guard support mechanism and the right chin guard support mechanism particularly large.

It is another object of the present invention to provide a helmet that allows a chin guard support mechanism capable of relatively excellently raising/lowering both a chin guard and a shield plate to have a relatively simple structure, allows to operate the chin guard support mechanism relatively smoothly, obviates the necessity of making the structure in a region including an end of the chin guard including the chin guard support mechanism and a vicinity thereof particularly bulky, and obviates the necessity of making the widthwise size of the helmet including the left chin guard support mechanism and the right chin guard support mechanism particularly large.

It is still another object of the present invention to provide a helmet capable of preventing the rise of a shield plate more than necessary because the shield plate rises by a first predetermined angle smaller than a second predetermined angle when the shield plate is raised while keeping a chin guard held at the lowermost position, and also capable of preventing the rise of the chin guard and the shield plate more than necessary because when the chin guard is raised by an angle larger than the first predetermined angle, the shield plate can also rise by the larger angle together with the chin guard and does not impede the rise of the chin guard when the chin guard rises by the angle larger than the first predetermined angle, and both the chin guard and the shield plate rise by only the second predetermined angle.

It is yet another object of the present invention to provide a helmet capable of relatively properly preventing, using a relatively simple arrangement, an unnecessary linear forward and backward movement of a first moving-side member with respect to a second fixed-side member at the time of forward and backward pivot of the former with respect to the latter.

It is still another object of the present invention to provide a helmet capable of more relatively properly preventing, using a simpler arrangement, an unnecessary linear forward and backward movement of a first moving-side member with respect to a second fixed-side member at the time of forward and backward pivot of the former with respect to the latter.

The present invention is directed to a helmet including left and right chin guard support mechanisms provided on a main cap body, and a chin guard whose regions including left and right ends and vicinities thereof are pivotally attached to the left and right chin guard support mechanisms, respectively, each of the left and right chin guard support mechanisms including a first fixed-side member fixed to the main cap body, and a first moving-side member fixed to the chin guard, wherein each of the left and right chin guard support mechanisms further includes a second fixed-side member fixed to the first fixed-side member, a convex or concave annular followed surface is provided on the second fixed-side member, a concave or convex annular following surface capable of pivoting forward and backward while following the convex or concave annular followed surface is provided on the first moving-side member, and when the chin guard pivots forward from a down position in a rising direction, the annular following surface pivots forward while following the annular followed surface to make the chin guard rise while moving forward.

Note that according to the first aspect of the present invention, the helmet further comprises a shield plate whose regions including left and right ends and vicinities thereof are pivotally attached to the left and right chin guard support mechanisms, respectively, wherein each of the left and right chin guard support mechanisms further includes a second moving-side member supported to be movable forward and backward substantially in forward and backward directions with respect to the first moving-side member, a second followed surface is provided on the first moving-side member, a second following surface capable of moving forward and backward while following the second followed surface is provided on the shield plate, and when the shield plate pivots forward from the down position in the rising direction with respect to the chin guard, the second following surface moves forward while following the second followed surface to make the shield plate rise while moving forward. According to a mode of the first aspect of the present invention, the helmet further comprises a first stopper portion provided on the second moving-side member, and a first stopped portion provided on the shield plate to be able to abut against the first stopper portion, a second stopper portion provided on the first fixed-side member, and a second stopped portion provided on the first moving-side member, and a third stopper portion provided on the second fixed-side member, and a third stopped portion provided on the shield plate, wherein when the shield plate rises by a first predetermined angle with respect to the chin guard, the first stopped portion abuts against the first stopper portion to prevent further rise of the shield plate, when the chin guard rises by a second predetermined angle larger than the first predetermined angle with respect to the main cap body, the second stopped portion abuts against the second stopper portion to prevent further rise of the chin guard, and when the shield plate substantially rises by the second predetermined angle with respect to the main cap body, the third stopped portion abuts against the third stopper portion to prevent further rise of the shield plate. In this case, the first predetermined angle preferably ranges from 30° to 60°, and more preferably ranges from 40° to 56°. The second predetermined angle preferably ranges from 60° to 100°, and more preferably ranges from 70° to 90°.

According to the second aspect of the present invention, the convex or concave annular followed surface includes a convex annular followed surface, and the concave or convex annular following surface includes a concave annular following surface.

According to the third aspect of the present invention, the concave or convex annular following surface substantially always contacts the convex or concave annular followed surface at three portions spaced apart from each other independently of a forward and backward pivot position of the first moving-side member with respect to the second fixed-side member, and the contacts at the three portions prevent an unnecessary linear forward and backward movement of the first moving-side member with respect to the second fixed-side member. According to a mode of the third aspect, the convex or concave annular followed surface includes a convex annular followed surface, the concave or convex annular following surface includes a concave annular following surface, and the contacts at the three portions include:

(i) a contact between a peripheral surface of a first convex followed surface portion of the convex annular followed surface and, out of the concave annular following surface, a region including a peripheral surface of a first concave following surface portion having a substantially same shape as the first convex followed surface portion and a vicinity thereof, (ii) a contact between a peripheral surface of a second convex followed surface portion of the convex annular followed surface and, out of the concave annular following surface, a region including a peripheral surface of a second concave following surface portion longer than the second convex followed surface portion in a circumferential direction and a vicinity thereof, and (iii) a contact between a peripheral surface of a followed surface main body portion having a substantially circular shape between the first convex followed surface portion and the second convex followed surface portion out of the convex annular followed surface, and a peripheral surface of a following surface portion having a bent shape of the concave annular following surface.

The above, and other, objects, features and advantages of present invention will become readily apparent from the following detailed description thereof which is to be read in connection with the accompanying drawings.

DETAILED DESCRIPTION OF THE INVENTION

Figure 1:
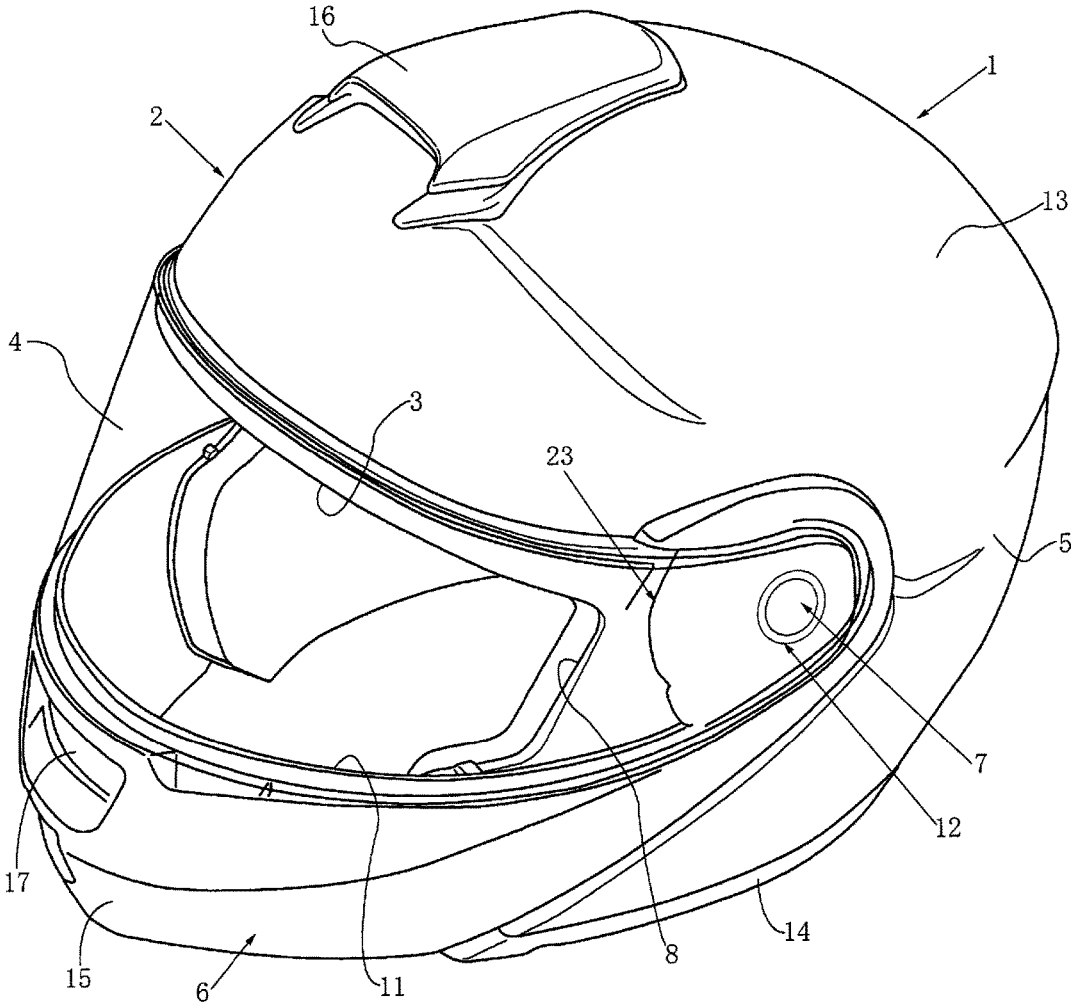
FIG. 1 is a perspective view of a helmet according to an embodiment of the present invention with a chin guard in a lowermost state.

An embodiment in which the present invention is applied to a full-face-type helmet including a chin guard capable of rising/lowering will now be described with reference to the accompanying drawings in "1. Schematic Arrangement of Helmet as a Whole", "2. Arrangement of Chin Guard Support Mechanism" and "3. Operation of Chin Guard Support Mechanism".

1. Schematic Arrangement of Helmet as a Whole

As shown in FIGS. 1 to 4, a full-face-type helmet 1 with a chin guard 6 capable of rising/lowering includes a full-face-type cap body 2 to be put on the head of a wearer such as a motorbike rider and including the chin guard 6 capable of rising/lowering, a shield plate 4 capable of opening/closing a window opening 3 formed in front of the cap body 2 to face a portion between the forehead and the chin of the wearer (that is, a substantially center of the face), and a pair of left and right chin bands (not shown) attached to the inside of the cap body 2.

The cap body 2 shown in FIGS. 1 to 4 includes a main cap body 5 that can have a substantially same shape as that of the cap body of a jet-type helmet, and the chin guard 6 serving as an auxiliary cap body attached to the main cap body 5 via a pair of left and right pivotal support means 7 on the left and right sides of the main cap body 5 to pivot forward and backward, as is known. Hence, a large window portion 8 is formed in the main cap body 5 by largely cutting the front surface from the lower end. The chin guard 6 includes a chin cover 6*a* that bends to bulge forward, and a pair of left and right attachment portions 6*b* that extend upward from the left and right ends of the chin cover 6*a* and are pivotally supported on the left and right sides of the cap body 2 by the pair of left and right pivotal support means 7 (in other words, chin guard support mechanisms 23 to be described later) to pivot forward and backward, as is known. When the chin guard 6 has pivoted downward with respect to the main cap body 5 to be located at the down position (especially the lowermost position shown in FIGS. 1 and 3), the chin guard 6 functions as a chin cover means for covering the chin of the wearer and closes the lower portion of the window portion 8. The window opening 3 is thus formed by the upper portion of the window portion 8. Hence, the window opening 3 is formed from a region surrounded by the upper edge of the window portion 8 of the main cap body 5 and an upper edge 11 of the chin guard 6.

The shield plate 4 shown in FIGS. 1 to 4 can be made of a hard transparent or semitransparent material such as polycarbonate or another hard synthetic resin, as is known. The shield plate 4 is attached to the main cap body 5 via a pair of left and right pivotal support means 12 (in other words, shield pivot members 25 to be described later) on the left and right sides of the main cap body 5. Note that when the chin guard 6 is located at the down position (especially the lowermost position shown in FIGS. 1 and 3) and functions as a chin cover means, the shield plate 4 closes the window opening 3 at its backward position (that is, down position) and opens the window opening 3 at its forward position (that is, up position).

The main cap body 5 shown in FIGS. 1 to 4 can include a jet-type outer shell 13 that constitutes the outer wall of the main cap body 5, a rim member 14 having a substantially U-shaped section and attached to substantially all around the end of the outer shell 13 by adhesion or the like, and a main cap body backing member (not shown) attached in abutment with the inner surface of the outer shell 13 by adhesion or the like, as is known. Note that the outer shell 13 can be made of a composite material formed by lining the inner surface of a strong shell main body made of FRP or another hard synthetic resin with a flexible sheet such as nonwoven fabric, as is known. The rim member 14 having the substantially U-shaped section can be made of a highly flexible elastic material such as foamed vinyl chloride, synthetic rubber, or another soft synthetic resin, as is known.

The main cap body backing member can include a main cap body shock absorbing liner attached to the inner surface of the main cap body outer shell 13 shown in FIGS. 1 to 4 by adhesion or the like, and a main cap body block-shaped interior pad and a main cap body backing cover which are sequentially attached to substantially cover the inner surface of the shock absorbing liner, as is known. The main cap body shock absorbing liner can be made of a material having appropriate rigidity and appropriate plasticity such as foamed polystyrene or another synthetic resin, as is known. The main cap body block-shaped interior pad can be formed from one or a plurality of highly flexible elastic materials such as urethane foam or another synthetic resin, and bag-shaped porous nonwoven fabric that covers the inner and outer surfaces of the elastic material, as is known. The main cap body backing cover can be made of porous nonwoven fabric whose surface facing the main cap body shock absorbing liner is laminated with a layer of a highly flexible elastic material such as urethane foam or another synthetic resin, as is known.

The chin guard 6 shown in FIGS. 1 to 4 can include an outer shell 15 that constitutes the outer wall of the chin guard 6, a rim member (not shown) having a substantially E-shaped section and attached to a portion of the end of the outer shell 15 (more specifically, the upper end of the outer shell 15) by adhesion or the like, and a chin guard backing member (not shown) attached in abutment with the inner surface of the outer shell 15 by adhesion or the like, as is known. Note that the outer shell 15 and the rim member having the substantially E-shaped section can be made of the same materials as already described concerning the outer shell 13 and the rim member 14 having the substantially U-shaped section for the main cap body, as is known.

Figure 2:
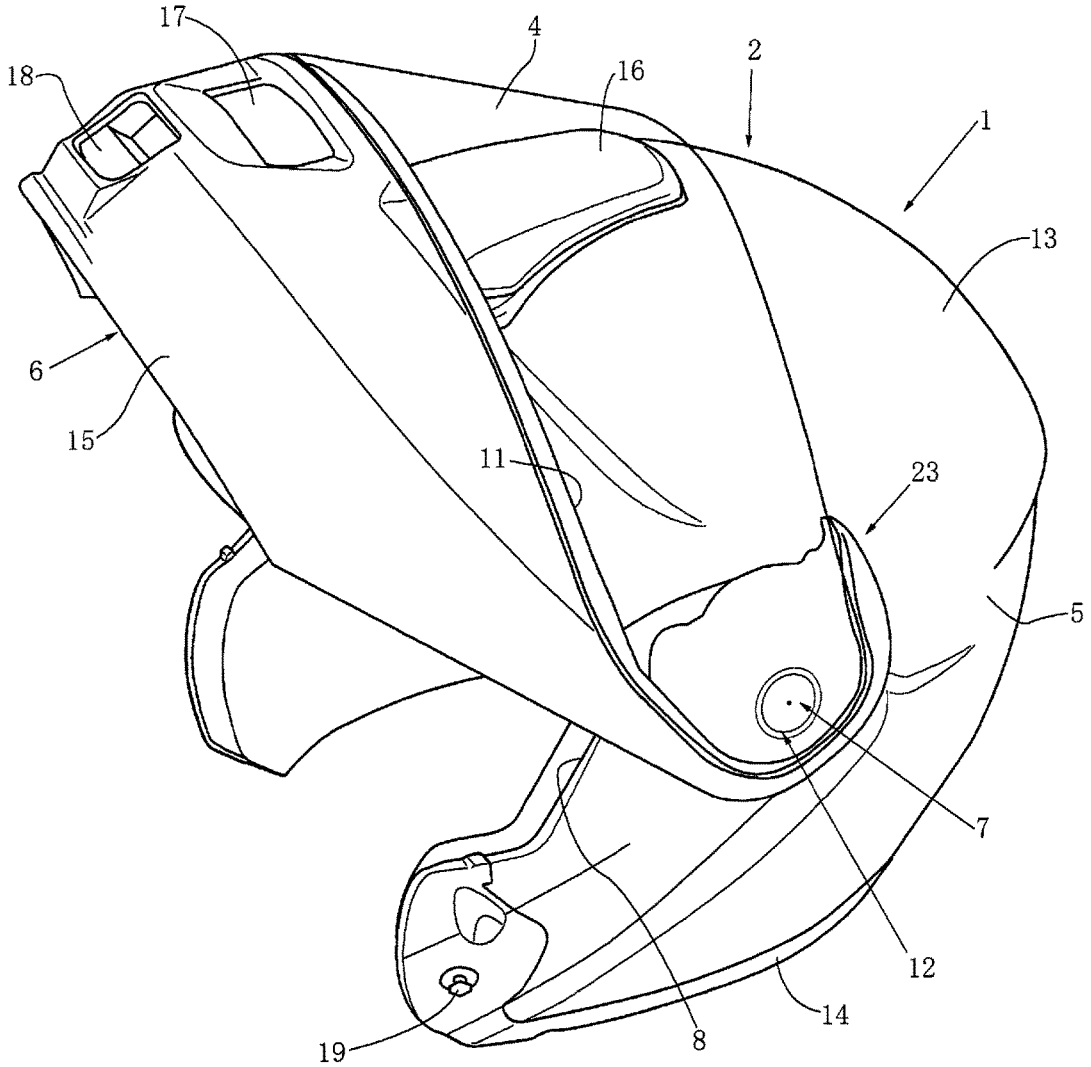
FIG. 2 is a perspective view of the helmet shown in FIG. 1 with the chin guard in an uppermost state.
Figure 3:
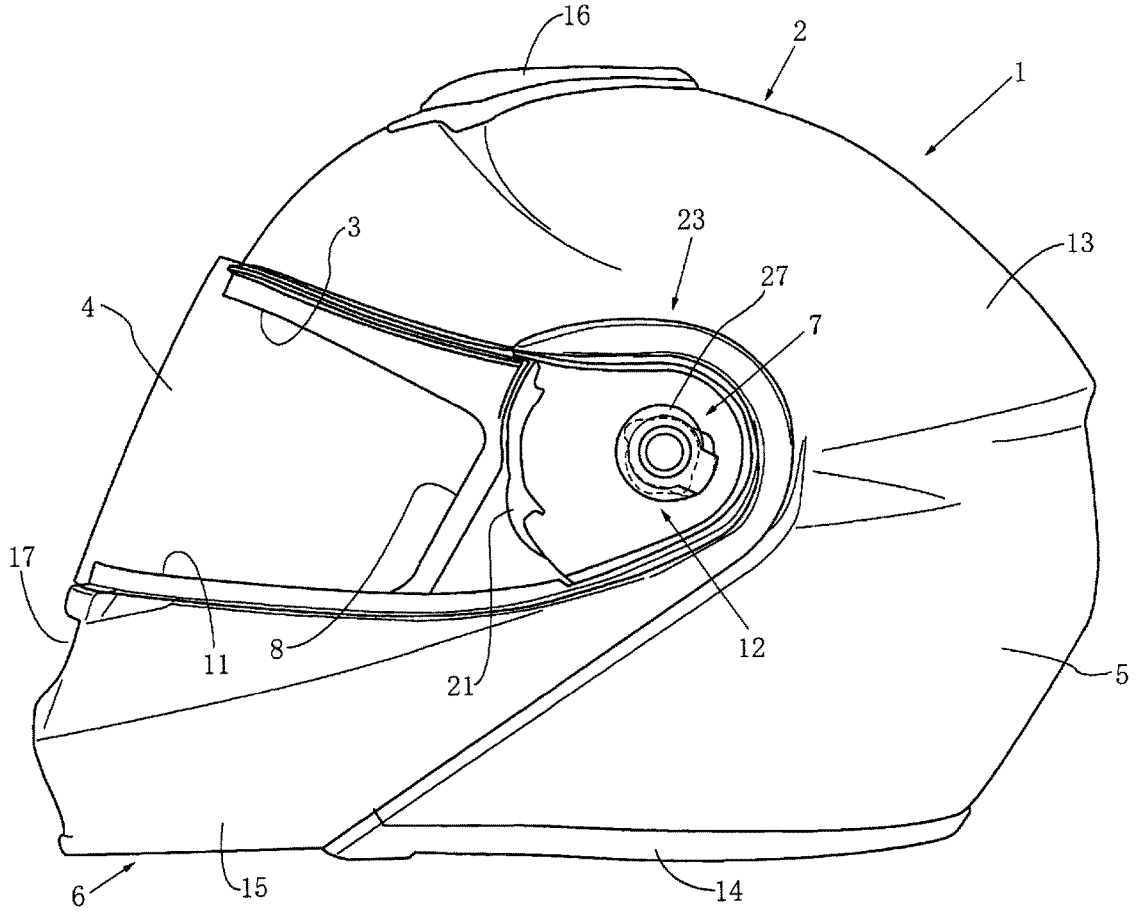
FIG. 3 is a left side view of the helmet shown in FIG. 1.
Figure 4:
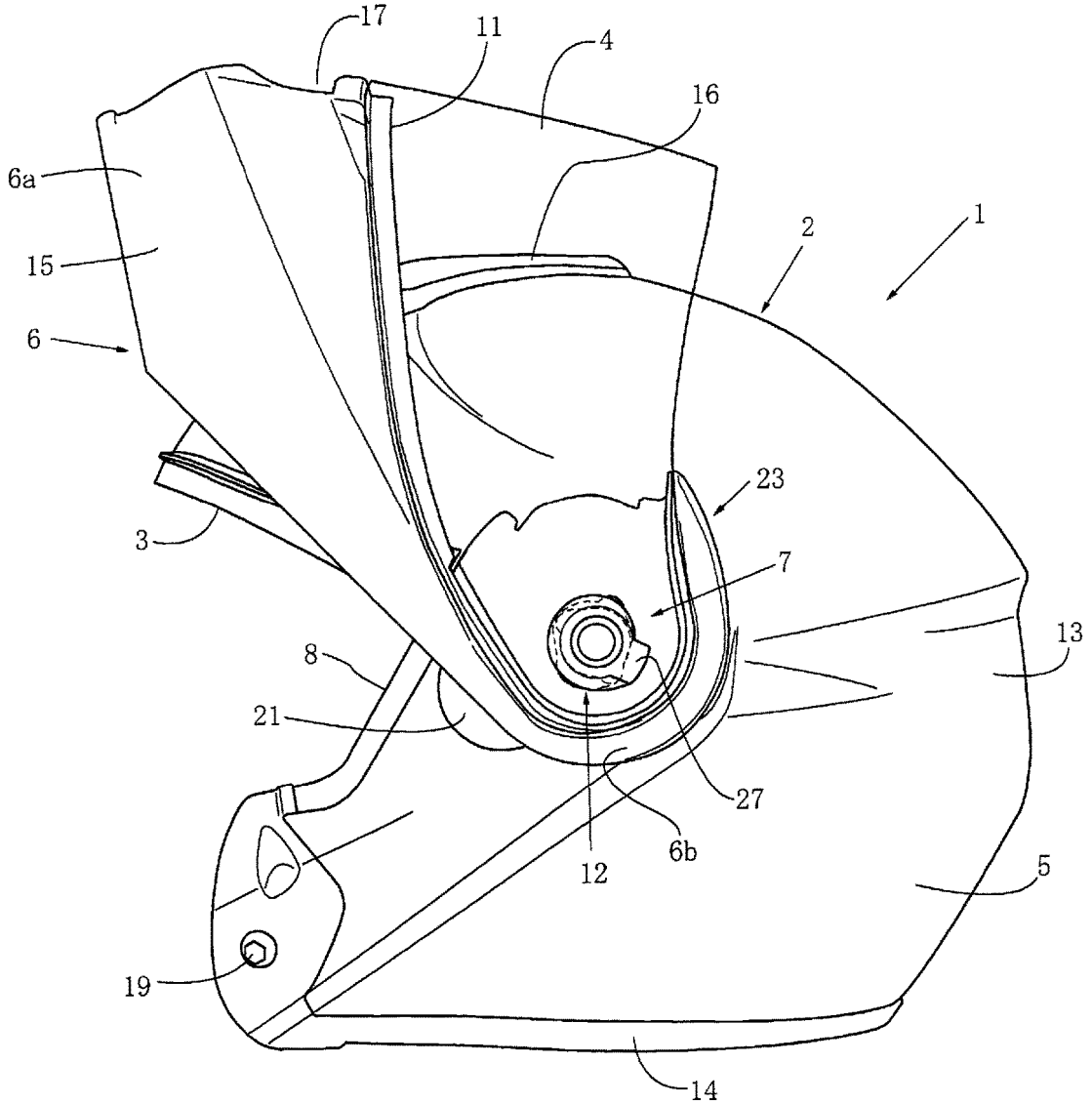
FIG. 4 is a left side view of the helmet shown in FIG. 3.

The chin guard backing member can include a chin guard shock absorbing liner attached to the inner surface of the chin guard outer shell 15 shown in FIGS. 1 to 4 by adhesion or the like, and a chin guard backing cover attached to substantially cover the inner surface of the shock absorbing liner, as is known. The chin guard shock absorbing liner can be made of a material having appropriate rigidity and appropriate plasticity such as urethane foam rubber or another synthetic resin. The chin guard backing cover can be made of artificial leather formed from a synthetic resin such as polyvinyl chloride, or another fabric. In addition, an air vent forming member 16 for the top of head is attached to the outer surface of the main cap body 5 in a region including the top of head and a vicinity thereof, as shown in FIGS. 1 to 4. An air vent 17 is formed in the chin cover 6*a* of the chin guard 6. Note that the chin guard 6 is provided with an unlock operation button 18 to be pressed to unlock a lock means (not shown) such as a lock pawl for locking the chin guard 6 at the lowermost position, as shown in FIG. 2. In addition, the main cap body 5 includes, on its outer surface, a lock pin 19 that engages with the lock means (not shown) to hold the chin guard 6 at the lowermost position, as shown in FIGS. 2, 4 and 5.

Figure 5:
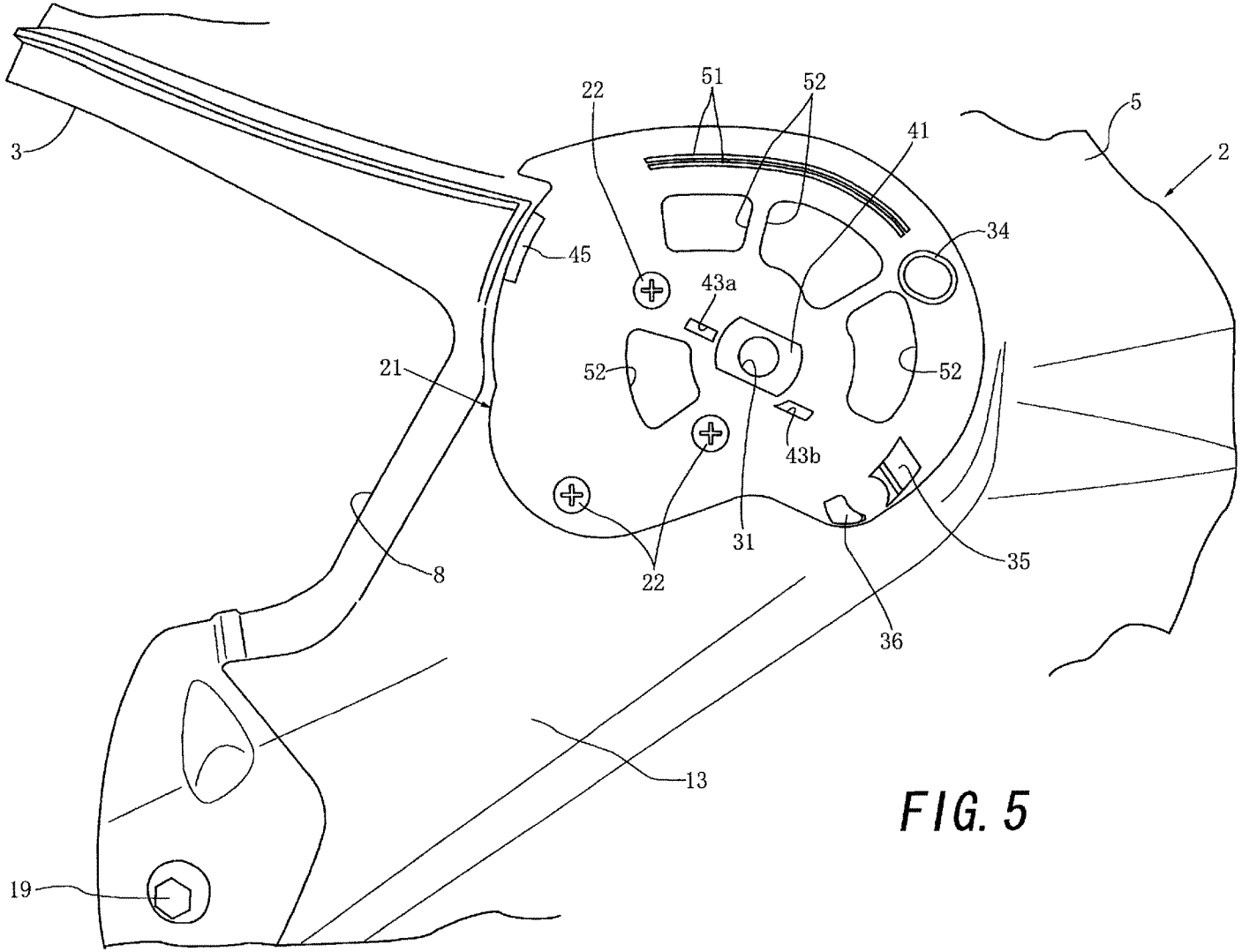
FIG. 5 is a left side view showing a state in which a support plate is attached to the left side surface of the main cap body outer shell of the helmet shown in FIG. 4 in the initial stage of an assembly process.

The main cap body 5 is provided with a pair of left and right support plates 21 to be used to support the shield plate 4 and the chin guard 6 on the main cap body 5, as shown in FIGS. 3 to 5. Each of the pair of left and right support plates 21 can be a substantially plate-shaped member made of an appropriate material, for example, a synthetic resin such as polyacetal resin or ABS resin, as shown in FIG. 5. The support plates 21 may be fixed to the main cap body outer shell 13 by attachment screws 22. Note that the arrangement and operation of the pair of left and right chin guard support mechanisms 23 for pivotally supporting the shield plate 4 and the chin guard 6 on the main cap body 5 will be described in detail in "2. Arrangement of Chin Guard Support Mechanism" and "3. Operation of Chin Guard Support Mechanism".

2. Arrangement of Chin Guard Support Mechanism

The chin guard support mechanism 23 on the left side and the chin guard support mechanism 23 on the right side of the pair of left and right chin guard support mechanisms 23 are formed to be bilaterally symmetrical to each other. Hence, the chin guard support mechanism 23 on the left side (in other words, the left side viewed from the wearer) will be described below with reference to the accompanying drawings, and a description of the chin guard support mechanism 23 on the right side will appropriately be omitted as needed.

Figure 6:
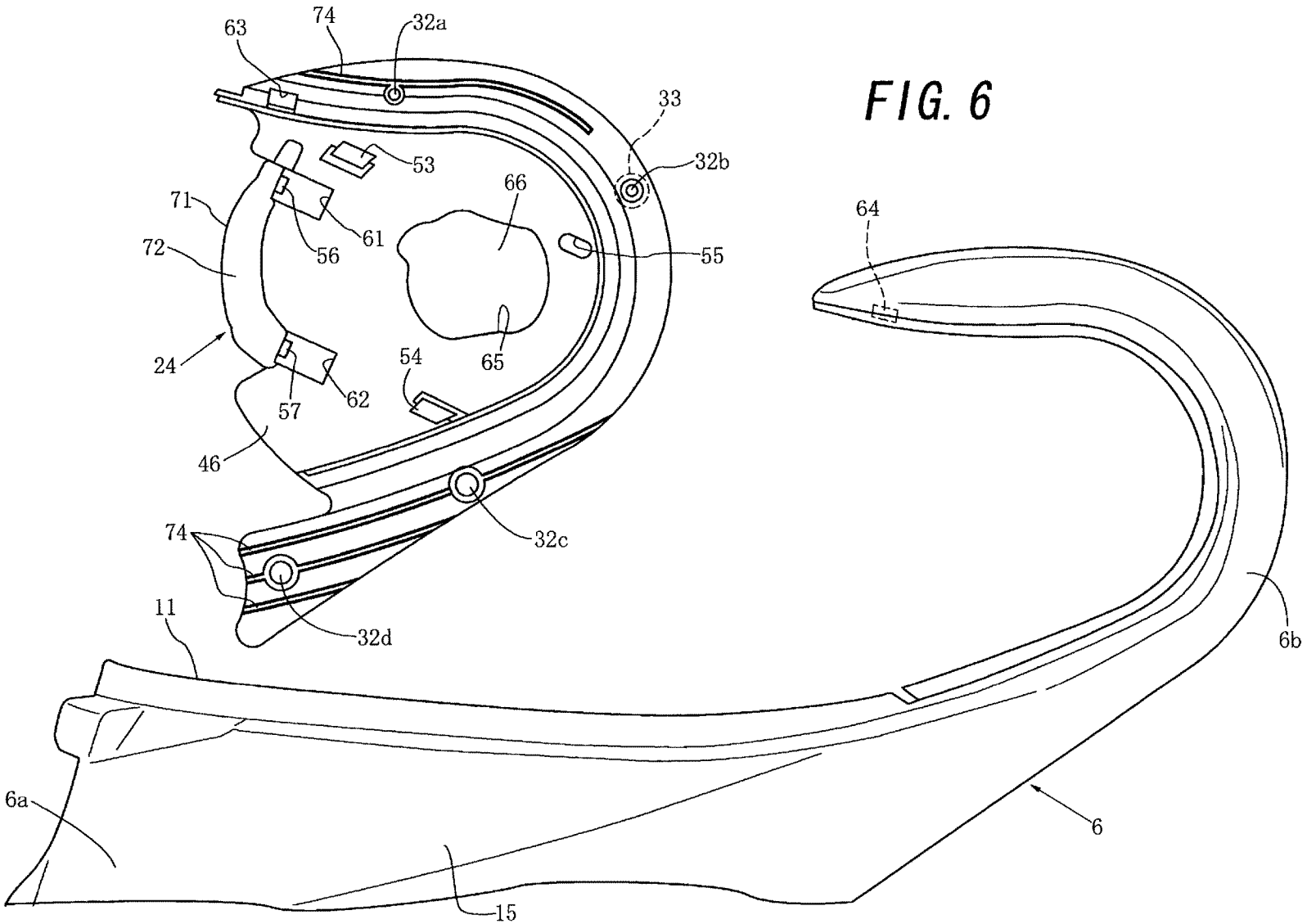
FIG. 6 is a left side view showing a state in which a chin guard attached to the main cap body outer shell shown in FIG. 5, and a shield base attached to the chin guard are spaced apart from each other.
Figure 7:
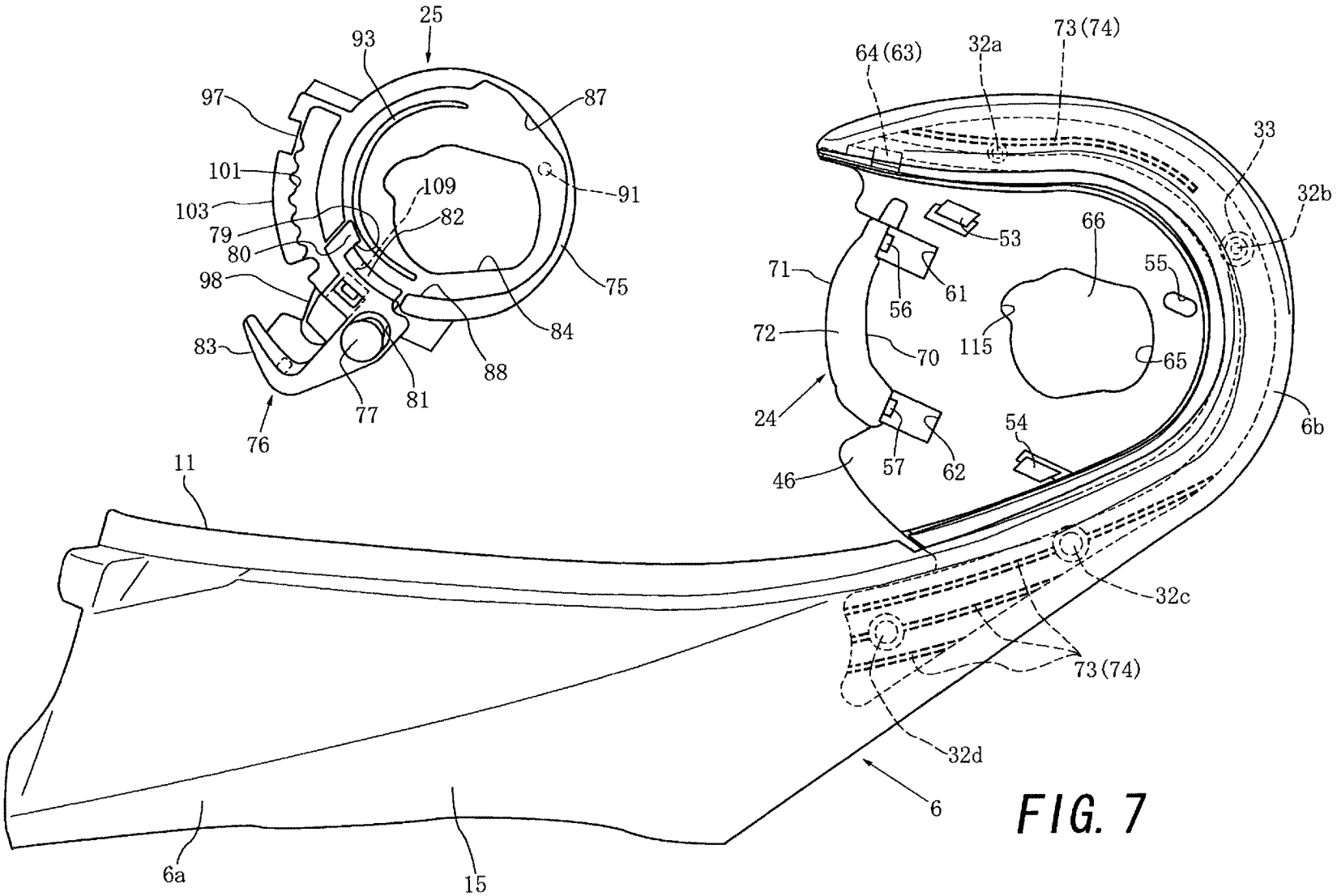
FIG. 7 is a left side view showing a state in which the chin guard shown in FIG. 6 with the shield base attached, and a shield pivot member attached to the shield base are spaced apart from each other.
Figure 8:
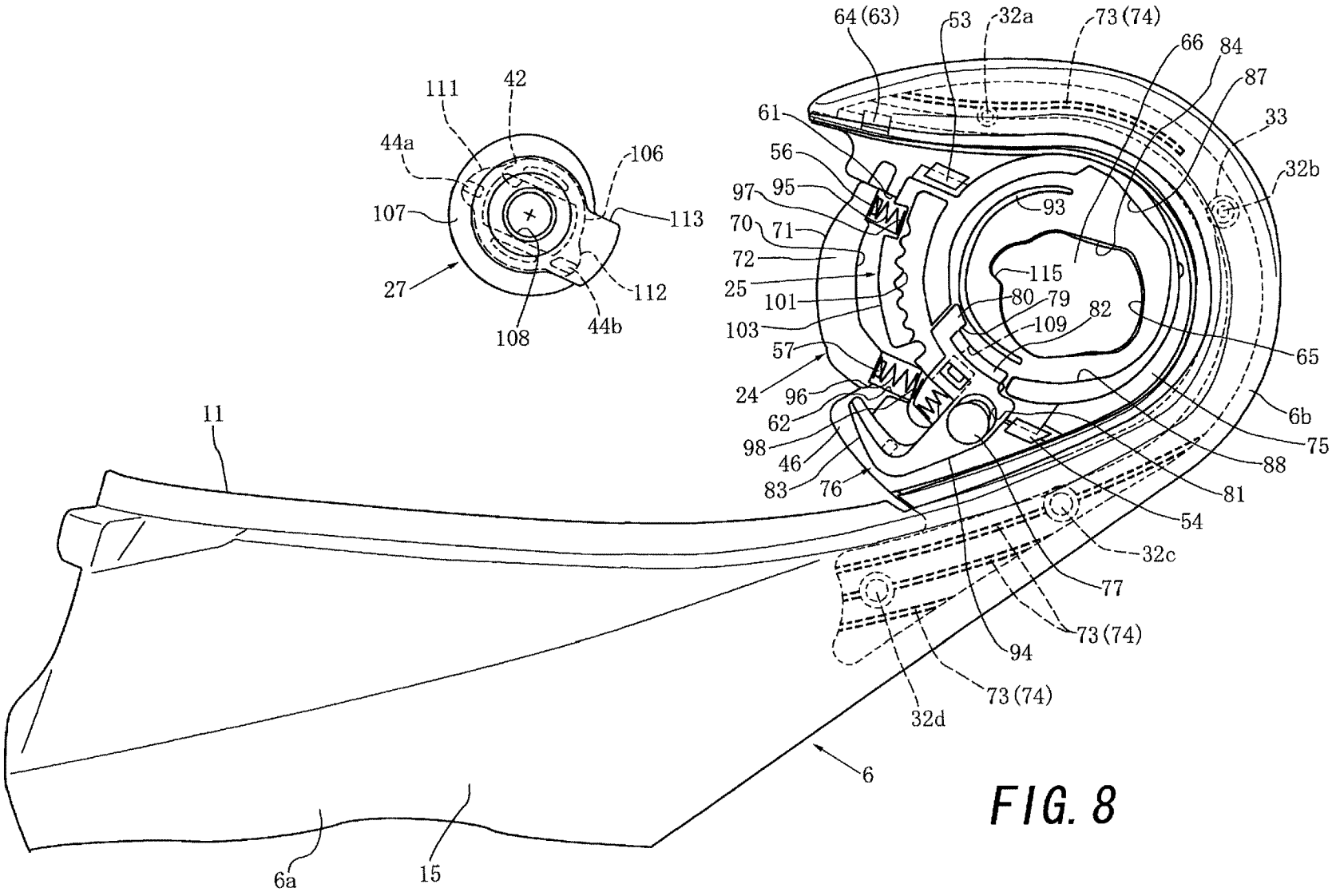
FIG. 8 is a left side view showing a state in which the chin guard shown in FIG. 7 with the shield pivot member attached to the shield base, and a shaft member with washer that pivotally supports the shield base are spaced apart from each other.
Figure 9:
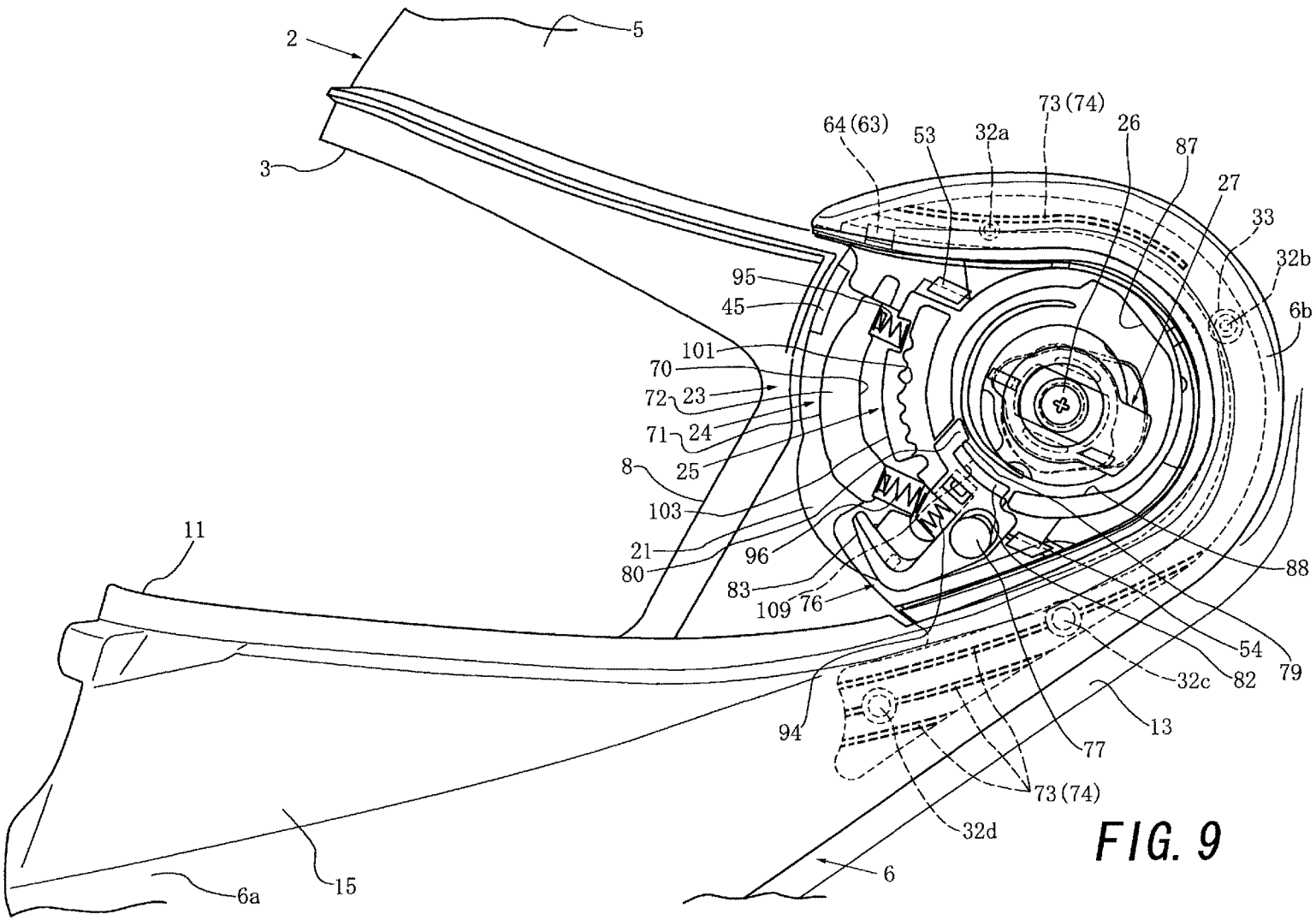
FIG. 9 is a left side view showing a state in which the chin guard shown in FIG. 8 is incorporated in the main cap body outer shell by bolting the shaft member with washer to a support plate.

The chin guard support mechanism 23 on the left side includes constituent members described in (a) to (d):

(a) the support plate 21 serving as a support portion, a base plate portion, or a first fixed-side member, and attached and fixed to the main cap body 5 by the attachment screws 22 serving as an attachment means, as shown in FIG. 5;

(b) a shield base 24 serving as a shield plate support portion, a shield plate base portion, or a first moving-side member, and attached and fixed to the attachment portion 6*b* of the chin guard 6, as shown in FIGS. 6 and 7;

(c) a shield pivot member 25 serving as a shield pivot portion or a second moving-side member, and attached to the shield base 24 to be linearly movable forward and backward, as shown in FIGS. 7 and 8; and (d) a shaft member 27 with washer serving as a second fixed-side member, and attached and fixed to the support plate 21 by a bolt 26 serving as a fixing means, as shown in FIGS. 8 and 9.

When assembly the chin guard support mechanism 23 from the constituent members described in (a) to (d), the support plate 21 is attached to the main cap body 5, as shown in FIG. 5. On the other hand, the shield base 24 is attached to the attachment portion 6*b* of the chin guard 6, as shown in FIG. 7. Next, the shield pivot member 25 is attached to the shield base 24, as shown in FIG. 8. The shaft member 27 with washer is fixed to the support plate 21 by the bolt 26, as shown in FIG. 9. In addition, a region including the left end of the shield plate 4 and a vicinity thereof is attached to the shield pivot member 25, thereby obtaining the helmet 1 shown in FIGS. 1 to 4.

As shown in FIG. 5, the support plate 21 has, at a substantially center, an insertion hole 31 that receives the bolt 26 when the bolt 26 is screwed and fixed to the outer shell 13. For example, four screw insertion holes 32*a* to 32*d* are formed in the shield base 24 along its outer periphery. Screws (not shown) inserted into the screw insertion holes 32*a* to 32*d* are screwed into screw holes (not shown) in the inner surface of the chin guard 6, thereby attaching the shield base 24 to the inner surface of the attachment portion 6*b* of the chin guard 6. For this purpose, the attachment portion 6*b* has a shape curved substantially upward and is formed into a substantially U shape fallen down sideways. The outer side surface of the outer periphery of the shield base 24 overlaps the attachment portion 6*b* along the inner surface of the outer periphery of the inner periphery of the outer periphery of the substantially U-shaped attachment portion 6*b*.

A cylindrical projection 33 having a cylindrical shape or the like and serving as a second stopped portion that projects outward (in other words, further inward) from the inner surface of the shield base 24 is disposed around the screw insertion hole 32*b* of the shield base 24, as shown in FIG. 6. A cylindrical projection 34 having an elongated cylindrical shape or the like in a size larger than that of the cylindrical projection 33 and a relatively low profile is disposed on the outer surface of the support plate 21 in correspondence with the cylindrical projection 33, as shown in FIG. 5. In addition, a columnar projection 35 having a substantially triangular prism shape fallen down sideways, which the cylindrical projection 33 can climb over, and a stopper projection 36 serving as a second stopper portion adjacent to the columnar projection 35 are disposed on the outer surface of the support plate 21 substantially in correspondence with the cylindrical projection 33.

A projection 41 that can have a substantially flat plate shape and has a substantially rectangular parallelepiped shape or the like is formed at a substantially center of the outer surface of the support plate 21 to surround the insertion hole 31, as shown in FIG. 5. In this case, when FIG. 5 is viewed two-dimensionally, out of the sides of the projection 41, a pair of long sides facing each other are formed to be substantially parallel to each other. Since the projection 41 is fitted in a fitting hole 42 formed in the inner surface of the shaft member 27 with washer, as shown in FIG. 9, the shaft member 27 with washer can slide forward and backward (in other words, move forward and backward) in the substantially parallel direction. Hence, performing the forward and backward sliding before the bolt 26 serving as a fixing means is screwed and fixed into the outer shell 13 enables to easily adjust the position such as the lowermost position of the chin guard 6 (and the shield plate 4 by extension) in the forward and backward directions. A pair of openings 43*a* and 43*b* are formed in regions including both sides of the projection 41 in the longitudinal direction and vicinities thereof. A pair of projections 44*a* and 44*b* disposed on the inner surface of the shaft member 27 with washer are fitted in the pair of openings 43*a* and 43*b*, respectively. This fitting allows to prevent the projection 41 from rattling in the fitting hole 42.

A rib-shaped projecting wall 45 formed into a substantially arc shape in a substantially vertical direction is disposed in a region including the front end of the support plate 21 and a vicinity thereof, as shown in FIG. 5. When the chin guard 6 is further raised for the intermediate up position, a projecting wall 46 of the shield base 24 runs on the projecting wall 45. For this reason, the shield base 24 and the chin guard 6 are opened outward in the periphery of the projecting wall 46. Hence, a portion of the chin guard 6, which overlaps the rim member 14 above the window opening 3 of the main cap body 5 (see FIG. 4), never comes into substantially contact (in other words, strongly rubs) with the rim member 14 above the window opening 3. As a result, the chin guard 6 never damages the rim member 14 above the window opening 3 upon rising/lowering.

An elongated protrusion 51 slidable in abutment with the inner surface of the shield base 24 when it pivots forward and backward is disposed in a region including the upper end of the outer surface of the support plate 21 and a vicinity thereof, as shown in FIG. 5. Note that the elongated protrusion 51 can be curved in an arc shape along the region including the upper end of the support plate 21 and the vicinity thereof. A plurality of elongated protrusions 51 (two in the illustrated embodiment) preferably run at a substantially equal interval. The support plate 21 has preferably a plurality of (four in the illustrated embodiment) relatively large through holes 52 to, for example, reduce the weight and save the materials.

A pair of engaging pawls 53 and 54 are disposed on the outer surface of the shield base 24, as shown in FIGS. 6 and 7. An engaging opening 55 is formed in the shield base 24. Note that the pair of engaging pawls 53 and 54 and the engaging opening 55 are provided at positions corresponding to the three corners of a substantially equilateral triangle. On the other hand, the shield base 24 is provided with a first spring engaging convex portion 56 near the engaging pawl 53. The shield base 24 is also provided with a second spring engaging convex portion 57 near the projecting wall 46. Note that the shield base 24 is provided with first and second spring relief openings 61 and 62 corresponding to the first and second spring engaging convex portions 56 and 57, respectively. In addition, an engaging opening 63 that engages with an engaging pawl 64 provided in a region including the distal end of the attachment portion 6*b* of the chin guard 6 and a vicinity thereof is provided in a region including the upper end and a vicinity thereof in a region including the front end of the shield base 24 and a vicinity thereof.

An opening 66 whose edge forms a concave annular following surface 65 is formed at a substantially center of the shield base 24, as shown in FIGS. 6 and 7. A projecting wall 72 whose front end surface forms a convex followed surface 71 serving as the second followed surface is provided at a substantially center in a region including the front end of the shield base 24 and a vicinity thereof. Preferably a plurality of engaging grooves 74, in which preferably a plurality of elongated protrusions 73 formed on the inner surface of the attachment portion 6*b* of the chin guard 6 are fitted, are formed in regions including the outer portions on the upper and lower sides of the shield base 24 and vicinities thereof.

The shield pivot member 25 includes a pivot member main body 75, an unlock operation member 76 attached to the pivot member main body 75 to be linearly movable forward and backward, and a guide pin 77 disposed on the pivot member main body 75 to guide the unlock operation member 76 such that it is linearly movable forward and backward, as shown in FIGS. 7 and 8. The operation member 76 has a long hole 81 to receive the guide pin 77. The operation member 76 also includes an engaging pawl 82 whose position is held by the pivot member main body 75 for satisfactory forward and backward linear movement. The unlock operation member 76 also includes a bent portion 83 to catch a finger at the distal end. A first stopper surface 109 serving as a first stopper portion formed by a step is provided on the inner surface of the engaging pawl 82 of the operation member 76. The unlock operation member 76 includes, on the proximal end side, a projection 80 that has a second stopper surface 79 serving as the first stopper portion formed by one side surface and projects substantially backward.

The pivot member main body 75 has an opening 84 serving as an unloaded hole to insert the shaft member 27 with washer to a substantially center of it, as shown in FIGS. 7 and 8. The pivot member main body 75 includes a first engaging pawl 87 that engages with a first engaged pawl 85 of the shield plate 4 shown in FIG. 10, and a second engaging pawl 88 that engages with a second engaged pawl 86 serving as the second stopped portion of the shield plate 4. Note that the moving-side engaging pawl 82 that linearly moves forward and backward forms part of the second engaging pawl 88. In addition, an engaged projection 91 to be guided by the engaging opening 55 of the shield base 24 is disposed on the inner surface of the pivot member main body 75.

Figure 10:
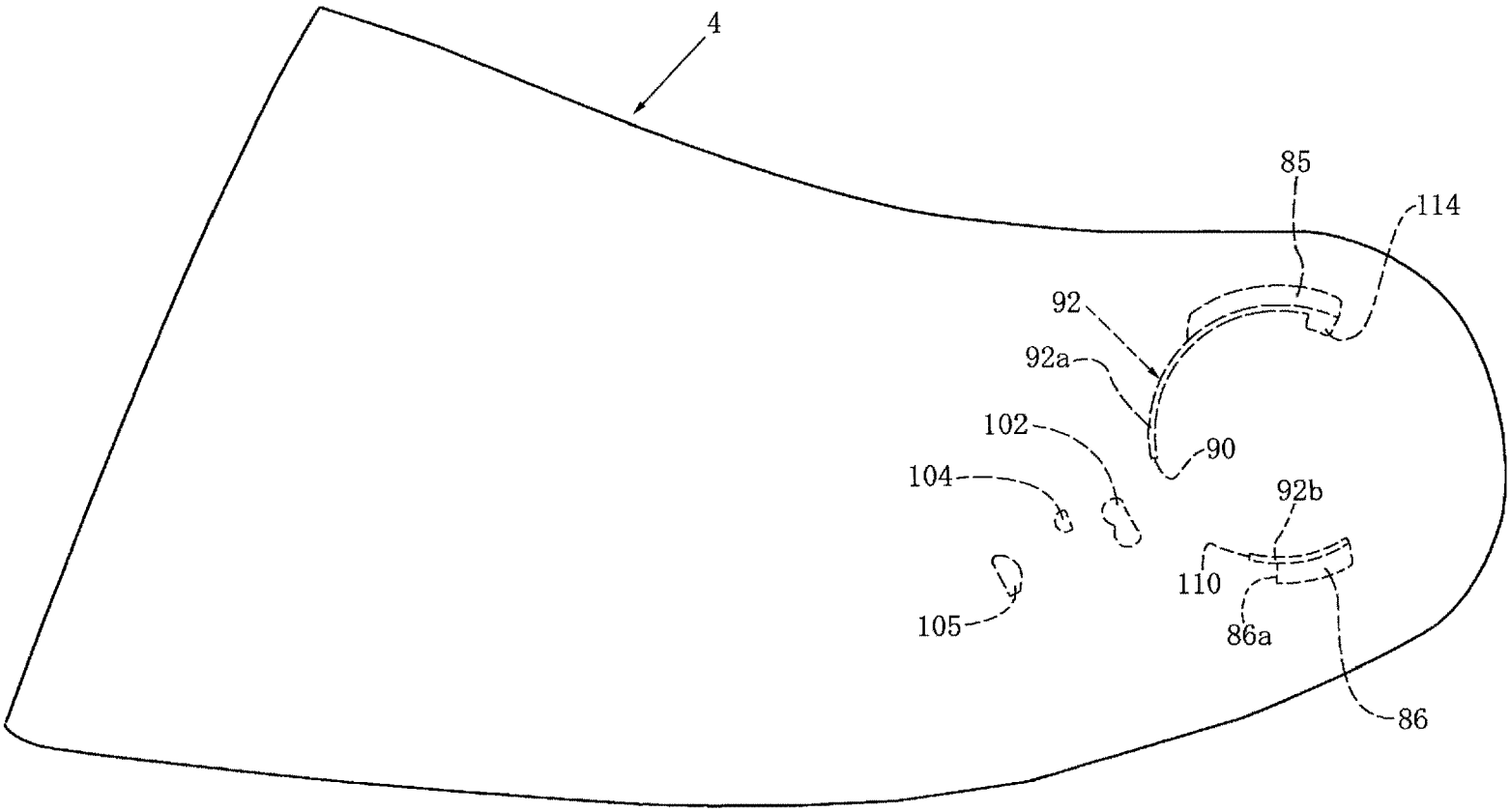
FIG. 10 is a left side view of a shield plate shown in FIG. 3.

The shield plate 4 is provided with a guided projecting wall 92 that runs in a substantially semicircular shape between the first engaged pawl 85 and the second engaged pawl 86, as shown in FIG. 10. Since a missing portion 90 exists near the second engaged pawl 86, the guided projecting wall 92 is formed from a first guided projecting wall 92*a* and a second guided projecting wall 92*b*. The pivot member main body 75 shown in FIGS. 7 and 8 is provided with a guide projecting wall 93 that guides the guided projecting wall 92 by its outer surface. A repulsive coil spring 94 serving as an elastic biasing means is interposed between the pivot member main body 75 and the unlock operation member 76, as shown in FIG. 8. First and second repulsive coil springs 95 and 96 each serving as an elastic biasing means are interposed between the shield base 24 and the pivot member main body 75. More specifically, the first repulsive coil spring 95 is interposed between the first spring engaging convex portion 56 and a first spring engaging concave portion 97 of the pivot member main body 75. The second repulsive coil spring 96 is interposed between the second spring engaging convex portion 57 and a second spring engaging concave portion 98 of the pivot member main body 75.

A corrugated clicking tooth portion 101 formed to face the side of the opening 84 is disposed on the pivot member main body 75 shown in FIGS. 7 and 8. A clicking tooth portion 102 that can engage with the clicking tooth portion 101 is disposed on the inner surface of the shield plate 4 shown in FIG. 10. A position holding projection 104 capable of moving forward and backward substantially along a followed surface 70 formed from the rear end surface on the opposite side of the followed surface 71 of the projecting wall 72 of the shield base 24 is disposed on the inner surface of the shield plate 4. In addition, a projection 105 serving as a second following surface capable of moving forward and backward substantially along the followed surface 71 of the projecting wall 72 of the shield base 24 shown in FIGS. 6 to 8 is disposed on the inner surface of the shield plate 4.

The shaft member 27 with washer includes a shaft portion 106, a washer portion 107 integrated with the shaft portion 106, and a center opening 108 extending through the whole shaft member 27 including the shaft portion 106 and the washer portion 107, as shown in FIGS. 8 and 9. The outer surface of the shaft portion 106 is provided with a pair of substantially front and back convex followed surfaces 111 and 112 substantially facing each other. The projections 44*a* and 44*b* of the shaft member 27 with washer are disposed on the inner surfaces of the convex followed surfaces 111 and 112 respectively. Since the diameter of the washer portion 107 gradually decreases clockwise in FIG. 8, a step portion 113 serving as a third stopper portion is formed on the outer surface of the washer portion 107. For this reason, the abutted portion 113 serving as a stopper surface is formed by the step portion. On the other hand, an abutting portion 114 serving as the third stopper portion disposed to face the first engaged pawl 85 at one end of the guided projecting wall 92 is formed on the shield plate 4 shown in FIG. 10. When the shield plate 4 that has already risen to some extent is set in the uppermost state (in other words, a state in which the shield plate has risen by 80°) by raising the chin guard 6, the abutting portion 114 abuts against the abutted portion 113 to prevent further rise of the shield plate 4.

3. Operation of Chin Guard Support Mechanism

Figure 11:
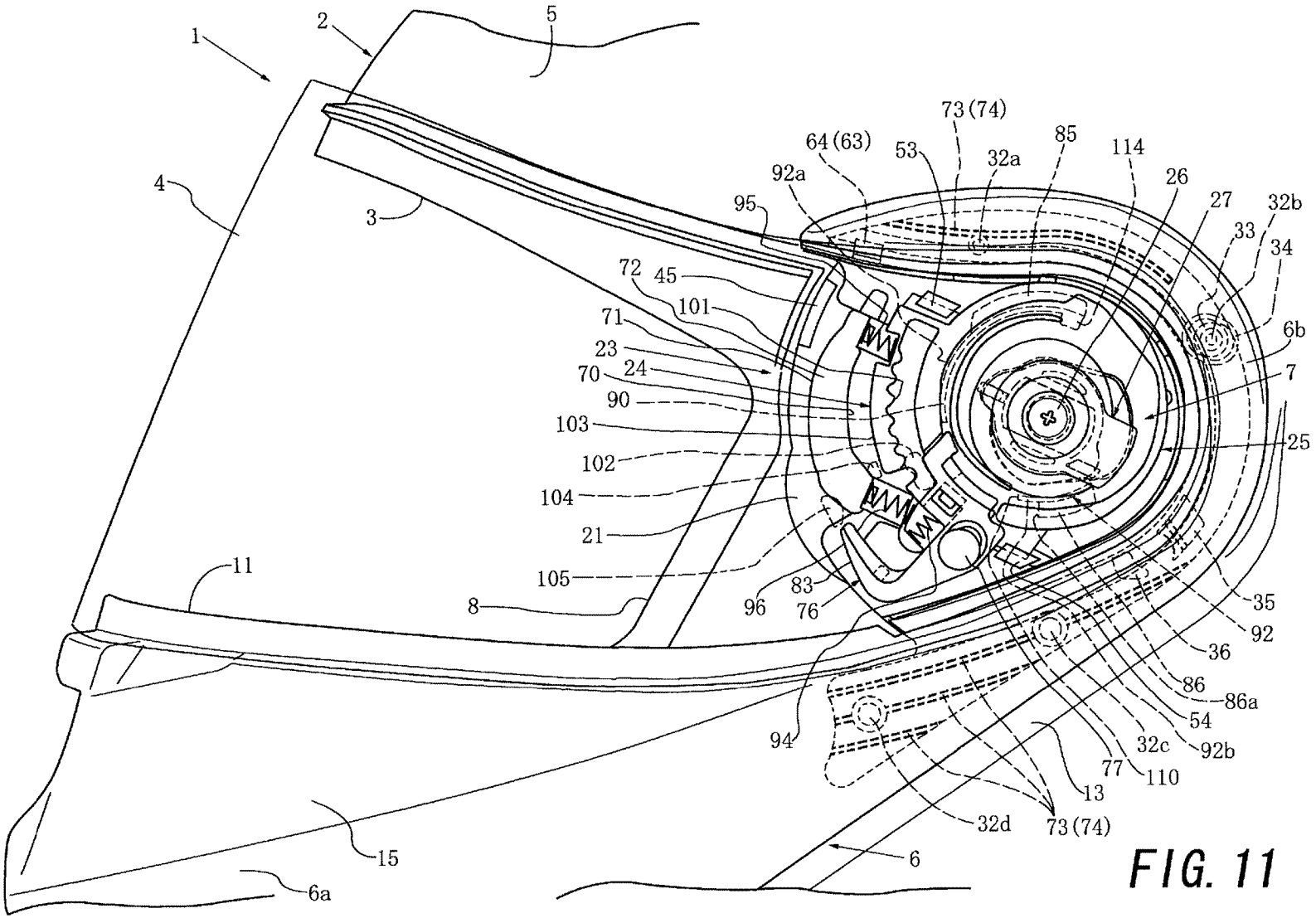
FIG. 11 is a partial left side view of the helmet shown in FIG. 3.
Figure 12:
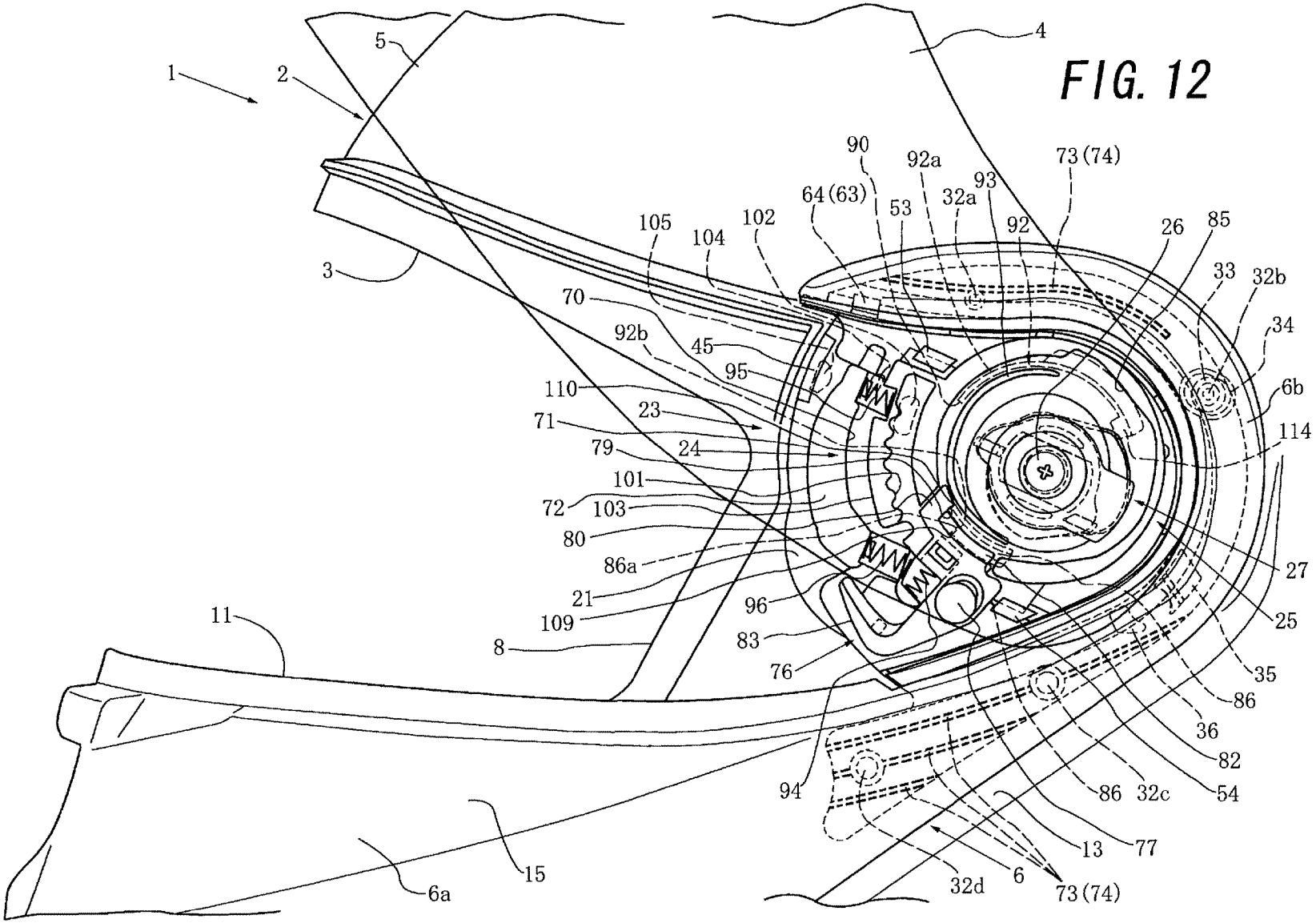
FIG. 12 is a left side view of the helmet shown in FIG. 11 with the shield plate being in the uppermost state.
Figure 13:
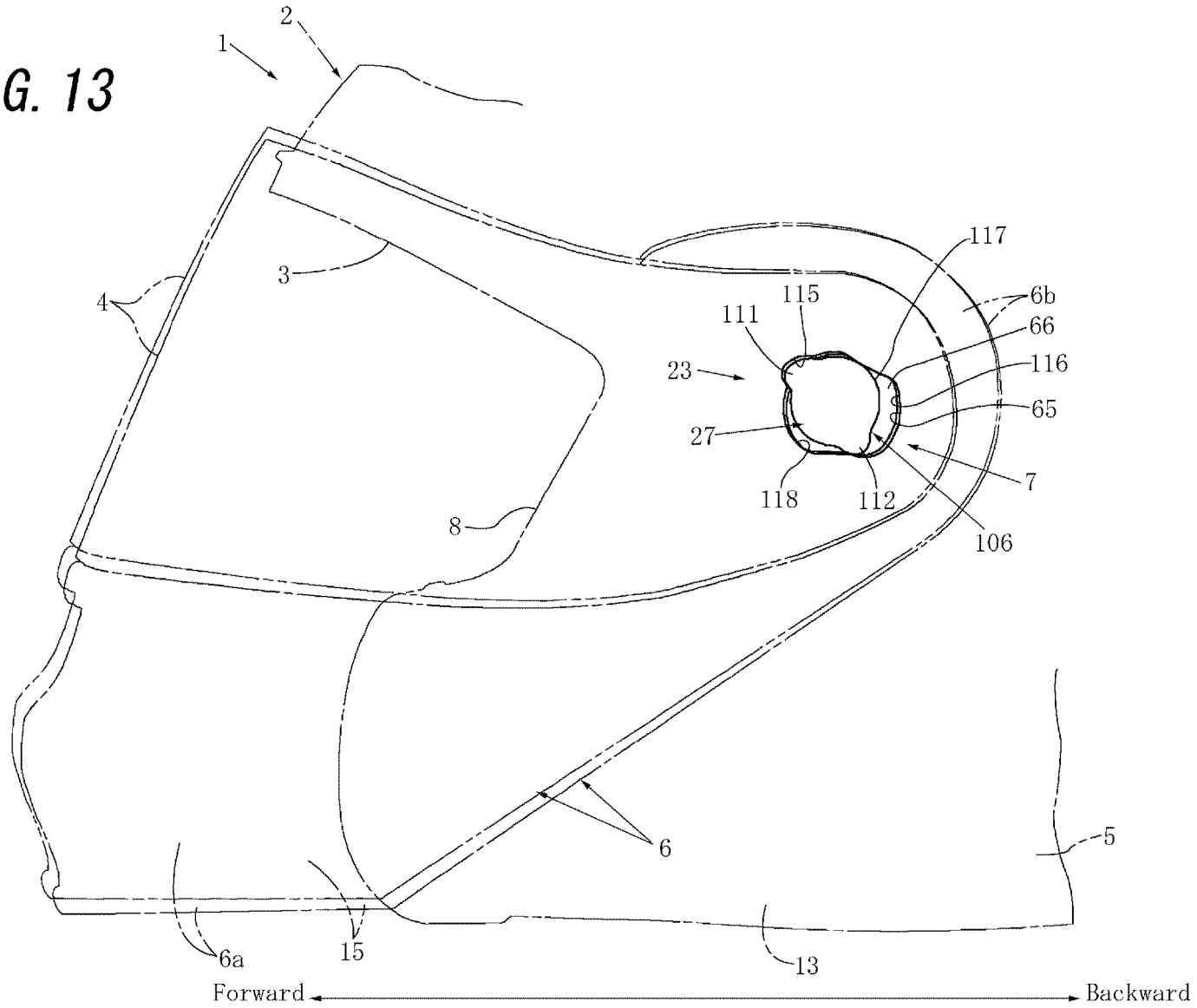
FIG. 13 is a partial left side view showing the lowermost state of the chin guard of the helmet shown in FIG. 3 and a state in which the chin guard has pivoted by 1° from the lowermost state in the rising direction.
Figure 14:
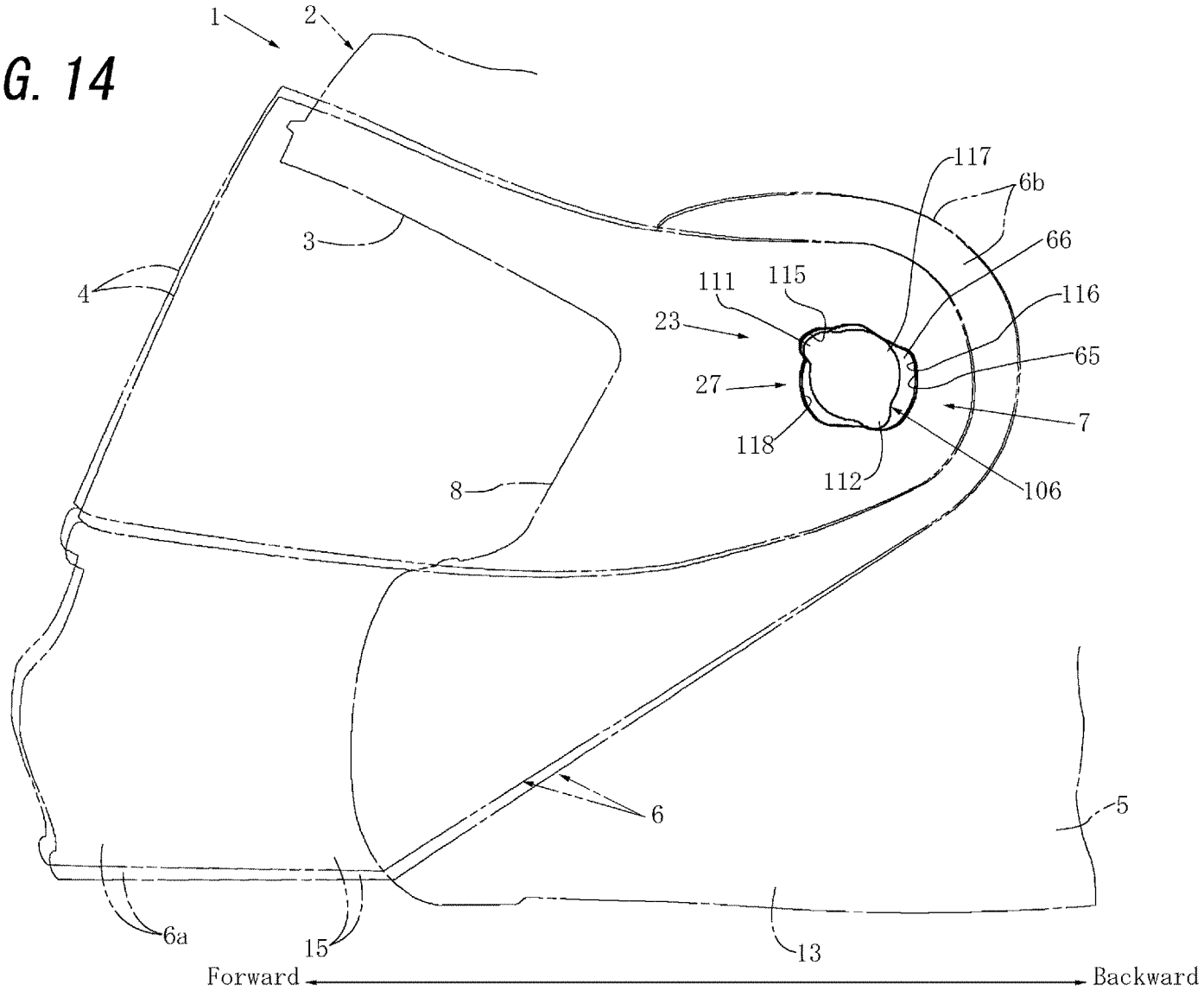
FIG. 14 is a left side view showing the state shown in FIG. 13 in which the chin guard of the helmet in FIG. 13 has raised by 1°, and a state in which the chin guard has further pivoted from the state shown in FIG. 13 in the rising direction to pivot by 2° from the lowermost state in the rising direction.
Figure 15:
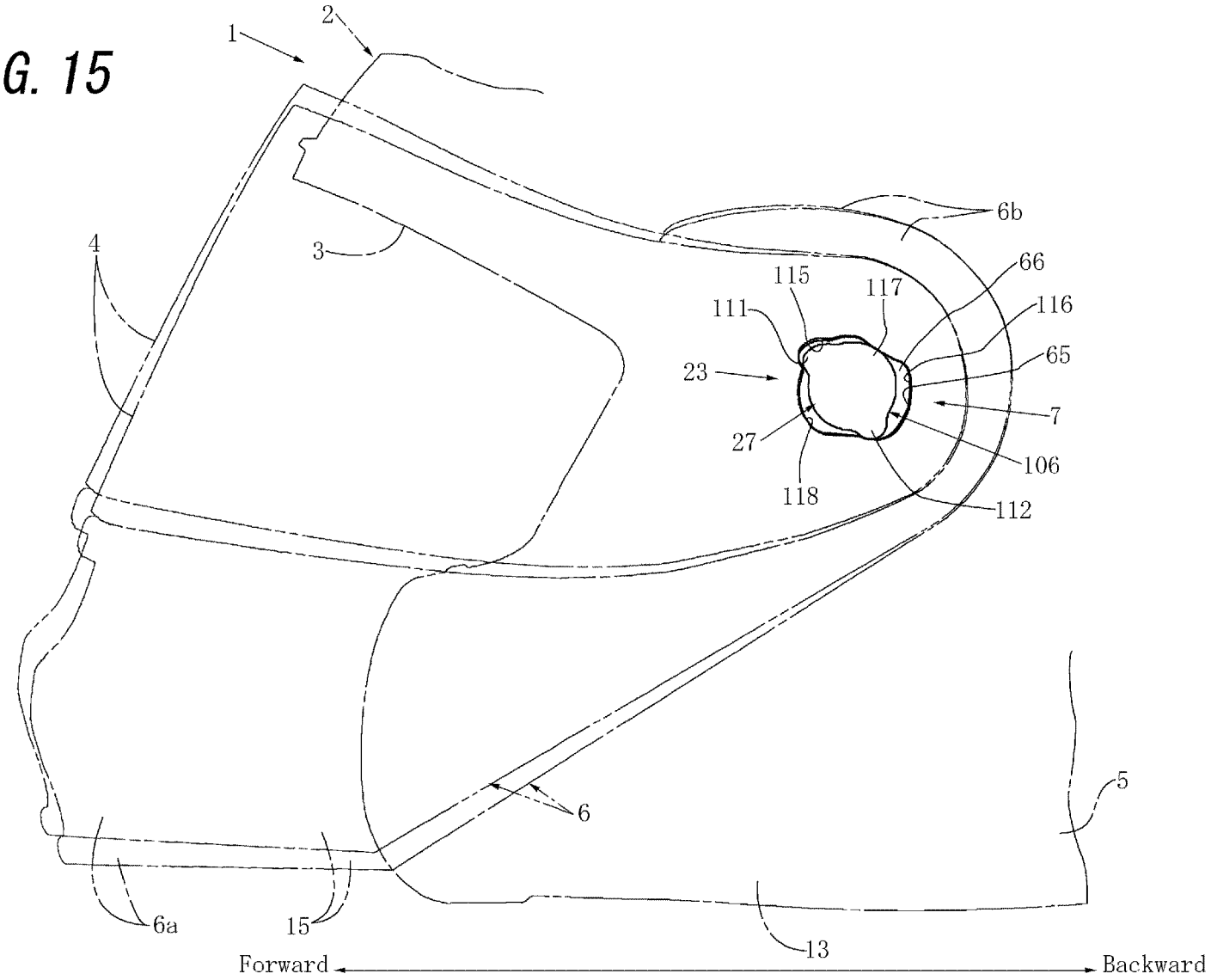
FIG. 15 is a left side view showing the state shown in FIG. 14 in which the chin guard of the helmet in FIG. 14 has raised by 2°, and a state in which the chin guard has further pivoted from the state shown in FIG. 14 in the rising direction to pivot by 4° from the lowermost state in the rising direction.
Figure 16:
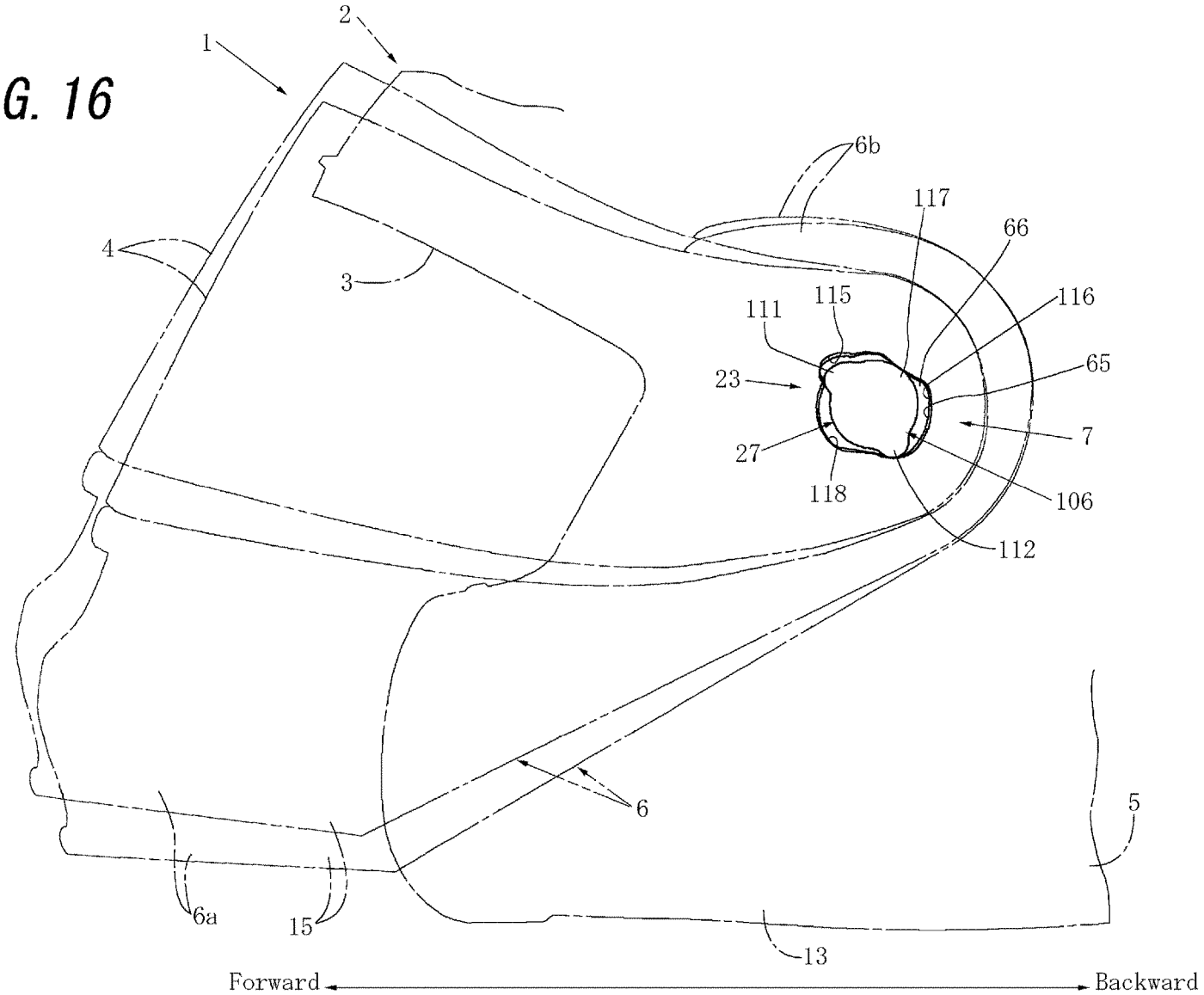
FIG. 16 is a left side view showing the state shown in FIG. 15 in which the chin guard of the helmet in FIG. 15 has raised by 4°, and a state in which the chin guard has further pivoted from the state shown in FIG. 15 in the rising direction to pivot by 8° from the lowermost state in the rising direction.
Figure 17:
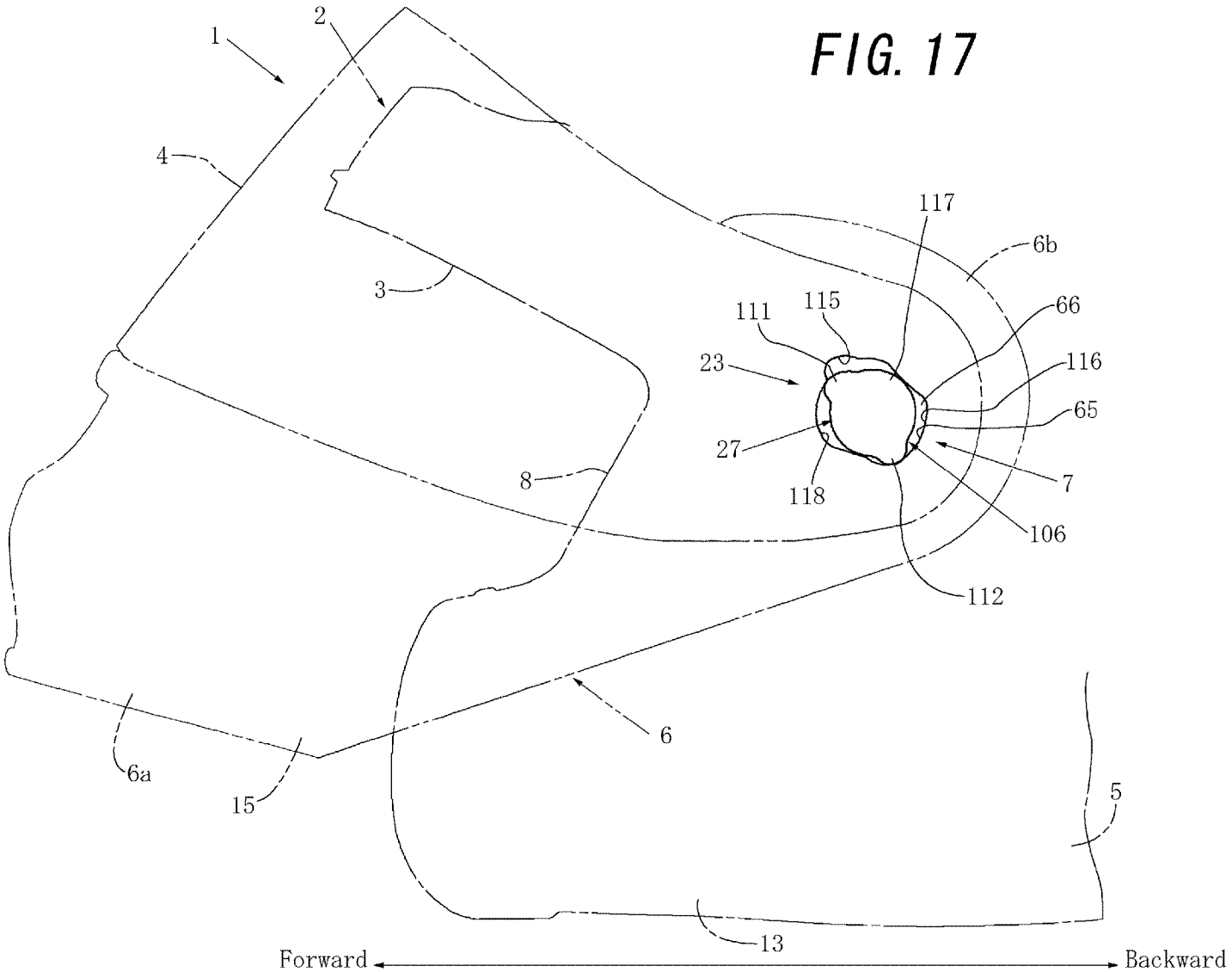
FIG. 17 is a partial left side view showing a state shown in which the chin guard of the helmet shown in FIG. 3 has pivoted by 16° from the lowermost state in the rising direction.
Figure 18:
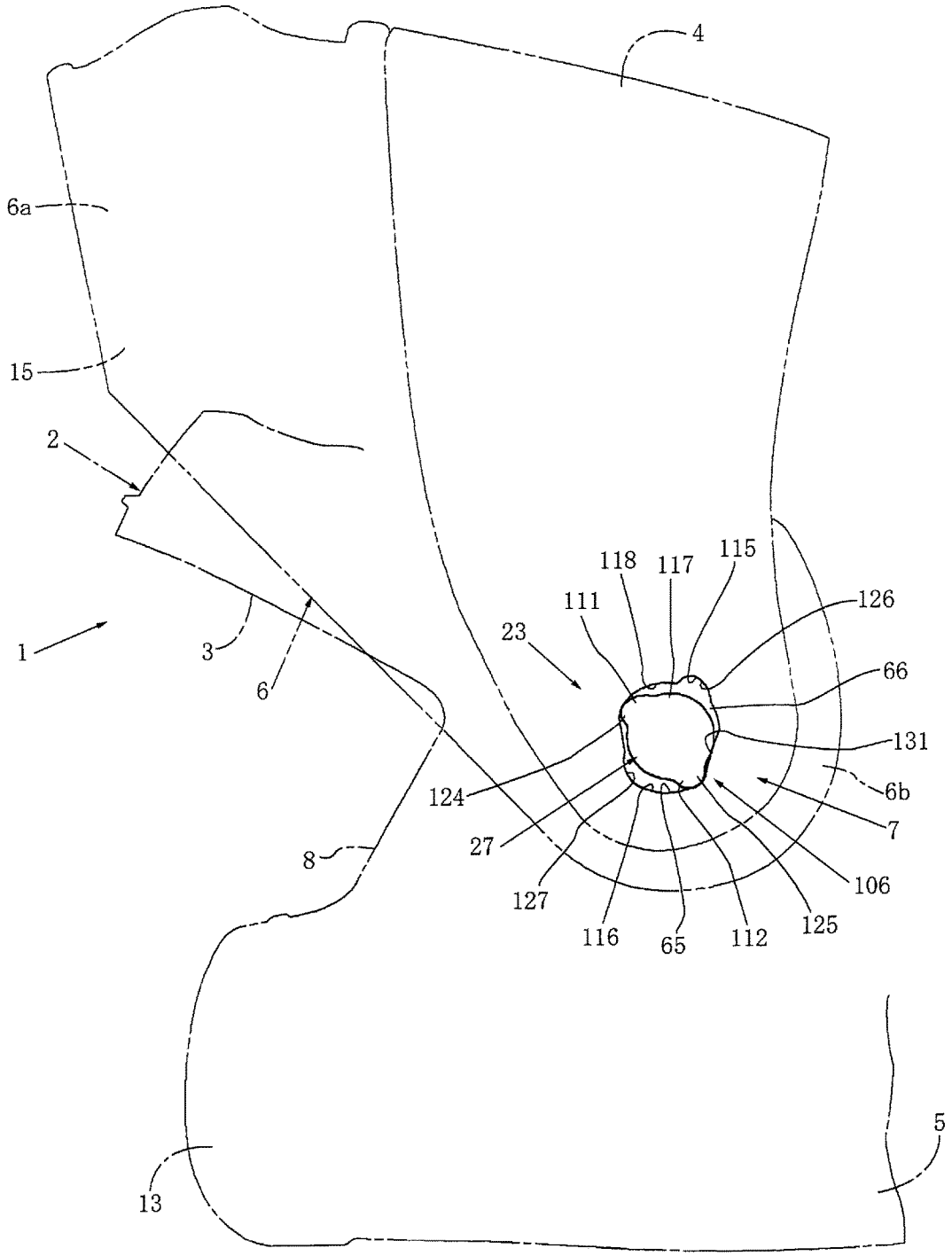
FIG. 18 is a partial left side view showing a state shown in which the chin guard of the helmet shown in FIG. 3 has pivoted by 80° from the lowermost state to the uppermost state in the rising direction.

The shield plate 4 can take at least each of:

(a) the lowermost state shown in FIGS. 1, 3, and 11, (b) a state in which the shield plate 4 has risen by 1° shown in FIG. 13, (c) a state in which the shield plate 4 has risen by 2° shown in FIG. 14, (d) a state in which the shield plate 4 has risen by 4° shown in FIG. 15, (e) a state in which the shield plate 4 has risen by 8° shown in FIG. 16, (f) a state in which the shield plate 4 has risen by 16° shown in FIG. 17, (g) a state in which the shield plate 4 has risen by 48° shown in FIG. 12 (in other words, the uppermost state of the shield plate 4 in the lowermost state of the chin guard 6), and (h) the uppermost state in which the shield plate 4 has risen by 80° shown in FIGS. 2, 4, and 18.

When the helmet wearer or the like performs an appropriate operation, the shield plate 4 can continuously rise from the state described in (a) to the state described in (h). In addition, when the helmet wearer or the like performs an appropriate operation, the shield plate 4 can continuously lower from the state described in (h) to the state described in (a).

The chin guard 6 can take at least each of:

(i) the lowermost state shown in FIGS. 1, 3, 9, 11, and 12, (j) a state in which the chin guard 6 has risen by 1° shown in FIG. 13, (k) a state in which the chin guard 6 has risen by 2° shown in FIG. 14, (l) a state in which the chin guard 6 has risen by 4° shown in FIG. 15, (m) a state in which the chin guard 6 has risen by 8° shown in FIG. 16, (n) a state in which the chin guard 6 has risen by 16° shown in FIG. 17, and (o) a state in which the chin guard 6 has risen by 80° shown in FIGS. 2, 4, and 18.

When the helmet wearer or the like performs an appropriate operation, the chin guard 6 can continuously rise from the state described in (i) to the state described in (o). In addition, when the helmet wearer or the like performs an appropriate operation, the chin guard 6 can continuously lower from the state described in (o) to the state described in (i).

As described above, the shield plate 4 and the chin guard 6 will be described below sequentially in:

(A) a state in which each of the shield plate 4 and the chin guard 6 is at the lowermost position, as shown in FIGS. 1, 3, 9, and 11, (B) a state in which each of the shield plate 4 and the chin guard 6 has risen by 1°, as shown in FIG. 13, (C) a state in which each of the shield plate 4 and the chin guard 6 has risen by 2°, as shown in FIG. 14, (D) a state in which each of the shield plate 4 and the chin guard 6 has risen by 4°, as shown in FIG. 15, (E) a state in which each of the shield plate 4 and the chin guard 6 has risen by 8°, as shown in FIG. 16, (F) a state in which each of the shield plate 4 and the chin guard 6 has risen by 16°, as shown in FIG. 17, (G) a state in which each of the shield plate 4 and the chin guard 6 has risen by 80°, as shown in FIGS. 2, 4, and 18, and (H) a state in which the chin guard 6 is located at the lowermost position, and only the shield plate 4 has risen by 48°, as shown in FIG. 12 with reference to the accompanying drawings.

Figure 13A:
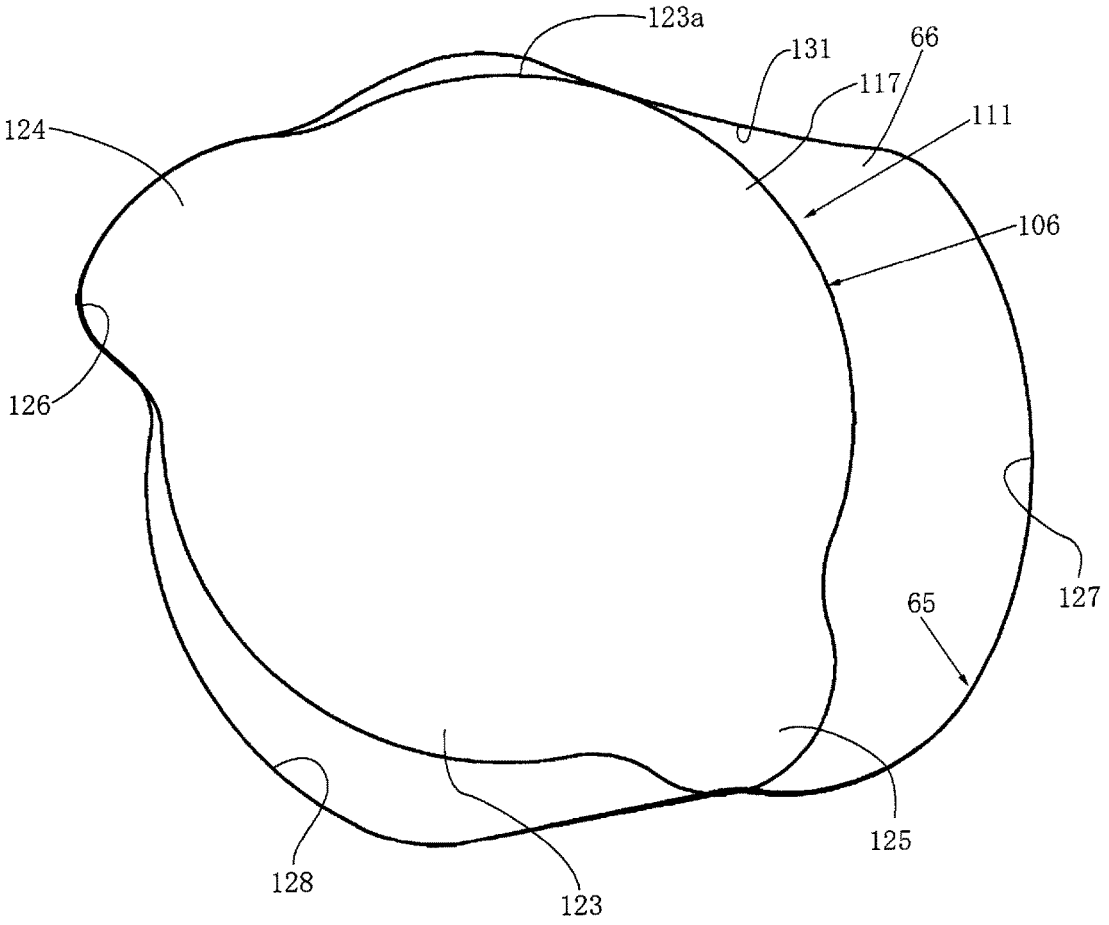
FIG. 13A is a partially enlarged left side view of the lowermost state of the chin guard shown in FIG. 13.
Figure 13B:
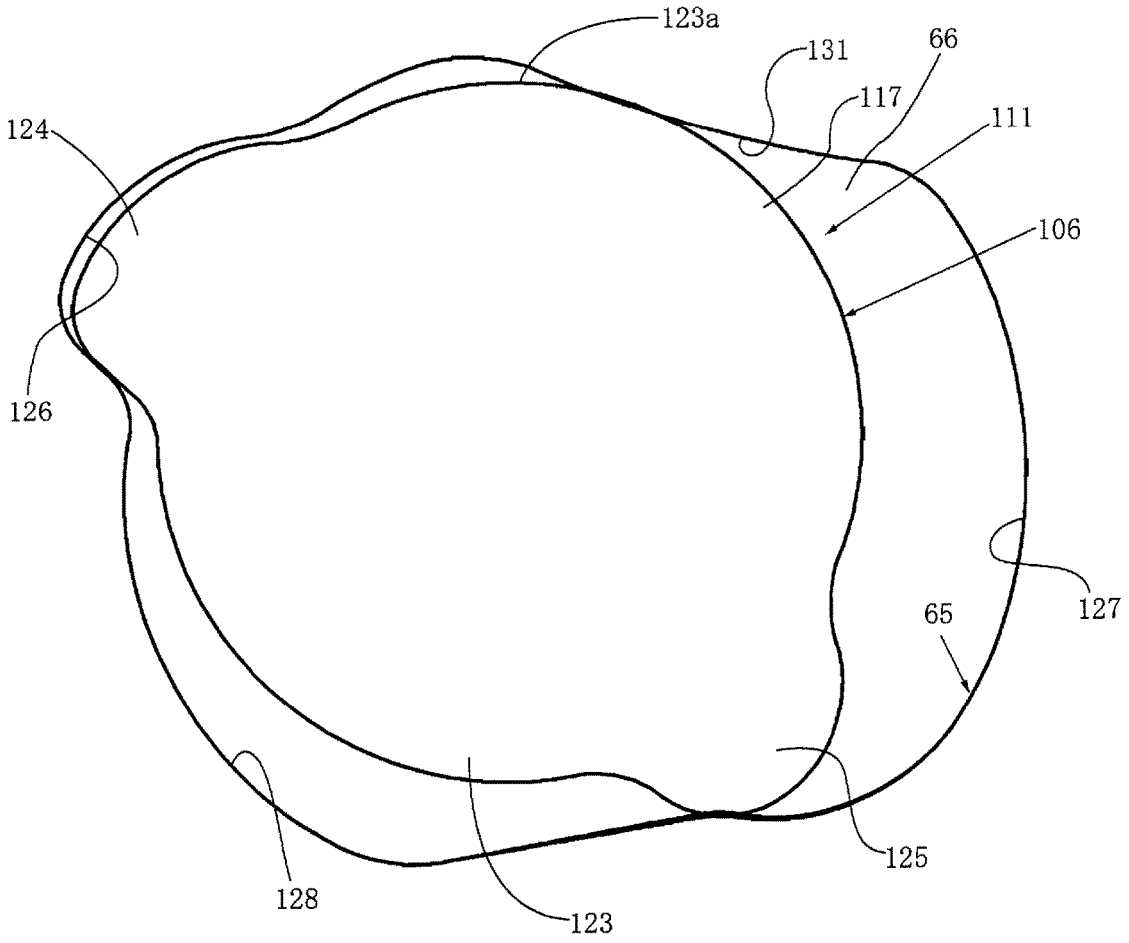
FIG. 13B is a partially enlarged left side view of the state shown in FIG. 13 in which the chin guard has pivoted by 1° from the lowermost state in the rising direction.

(A) State in which Shield Plate 4 and Chin Guard 6 are at Lowermost Position In the state described in (A), a lock means (not shown) such as a lock pawl of the chin guard 6 engages with the lock pin 19 of the main cap body 5 shown in FIGS. 2, 4, and 5, thereby holding the chin guard 6 at the lowermost position shown in FIGS. 1, 3, 9, and 11. In this state, the convex annular followed surface 111 formed from the outer surface of the shaft portion 106 of the shaft member 27 with washer partially contacts the concave annular following surface 65 formed from the edge of the opening 66 of the shield base 24, as indicated by the alternate long and short dashed line in FIG. 13. More specifically, the convex annular followed surface 111 includes a followed surface main body portion 123 having a substantially circular shape when viewed two-dimensionally, and a pair of substantially mountain-shaped convex followed surface portions 124 and 125 projecting from the main body portion 123 outward to face each other, as shown in FIGS. 13A and 13B. The concave annular following surface 65 includes a concave following surface portion 126 arranged to fit on, engage with, or contact the convex followed surface portion 124 and having a substantial mountain shape substantially corresponding to the convex followed surface portion 124, a concave following surface portion 127 arranged to contact the convex followed surface portion 125 and configured to be much longer in the circumferential direction (in other words, wider) than the convex followed surface portion 125, and a following surface portion 131 having a bent shape and arranged on one side between the pair of concave following surface portions 126 and 127 to contact the followed surface main body portion 123 having a substantially circular shape. Note that the total of three portions, that is the concave following surface portions 126 and 127 and the following surface portion 131 having the bent shape are arranged at sufficient distances.

When the chin guard 6 is located at the lowermost position indicated by the alternate long and short dashed line in FIG. 13, the convex annular followed surface 111 contacts the concave following surface portion 126 at three portions described in (i) to (iii), as shown in FIG. 13A:

(i) the surfaces contact each other as the peripheral surface of the convex followed surface portion 124 relatively engages with a region including the peripheral surface of the concave following surface portion 126 and a vicinity thereof;

(ii) the surfaces contact each other as the peripheral surface of the convex followed surface portion 125 relatively contacts with a region including the peripheral surface of the concave following surface portion 127 long in the circumferential direction and a vicinity thereof; and (iii) the surfaces contact each other as a portion 123*a* on one side out of the followed surface main body portion 123 having a substantially circular shape between the convex followed surface portions 124 and 125 contacts the following surface portion 131 having a bent shape.

Hence, the shaft member 27 with washer holds the opening 66 at a predetermined position by contacts at the three portions (to be referred to as "the contacts at the three portions" hereinafter). Note that the contacts at the three portions are substantially always done independently of the up positions of the chin guard 6 and the shield plate 4.

The position of the shield plate 4 in the lowering direction is regulated by a rim member (not shown) such as rim rubber extending along the upper end of the chin cover 6*a* of the chin guard 6. The position of the shield plate 4 in the rising direction is regulated by engaging the clicking tooth portion 102 of the shield plate 4 with the clicking tooth portion 101 of the pivot member main body 75 shown in FIG. 7. A lock lever (not shown) can be provided as needed. In this case, the shield plate 4 is locked by operating the lock lever, thereby forcibly preventing the rise of the shield plate 4. When the lock lever is operated to an unlock state, the shield plate 4 can manually be raised. The shield plate 4 can also manually be raised and lowered while keeping the chin guard 6 held at the lowermost position.

(B) State in which Shield Plate 4 and Chin Guard 6 have Risen by 1°

To change the state described in (A) indicated by the alternate long and short dashed line in FIG. 13 (in other words, the state shown in FIG. 13A) to the state described in (B) indicated by the alternate long and two short dashed line in FIG. 13 (in other words, the state shown in FIG. 13B), the unlock operation button 18 shown in FIG. 2 is pressed substantially downward. With this press operation, the lock means of the chin guard 6 disengages from the lock pin 19 of the main cap body 5. In addition, the chin guard 6 is manually raised by 1°. For this reason, the opening 66 of the shield base 24 slightly pivots clockwise in FIG. 13 with respect to the shaft portion 106 of the shaft member 27 with washer. The concave annular following surface 65 of the opening 66 is going to slightly rise with respect to the convex annular followed surface 111 of the shaft portion 106, and therefore moves obliquely forward as well while slightly rising. In this case, the shield pivot member 25 that is integrally coupled to the chin guard 6 at this point of time moves integrally with the shield base 24. For this reason, the shield plate 4 located at the position indicated by the alternate long and short dashed line in FIG. 13 moves substantially integrally with the chin guard 6, as indicated by the alternate long and two short dashed line in FIG. 13. The linear movement of the shaft portion 106 relative to the opening 66 is prevented by the contacts at the three portions. For this reason, each of the chin guard 6 and the shield plate 4 rises from the position indicated by the alternate long and short dashed line in FIG. 13 to the position indicated by the alternate long and two short dashed line in FIG. 13, and also moves forward.

Figure 19:
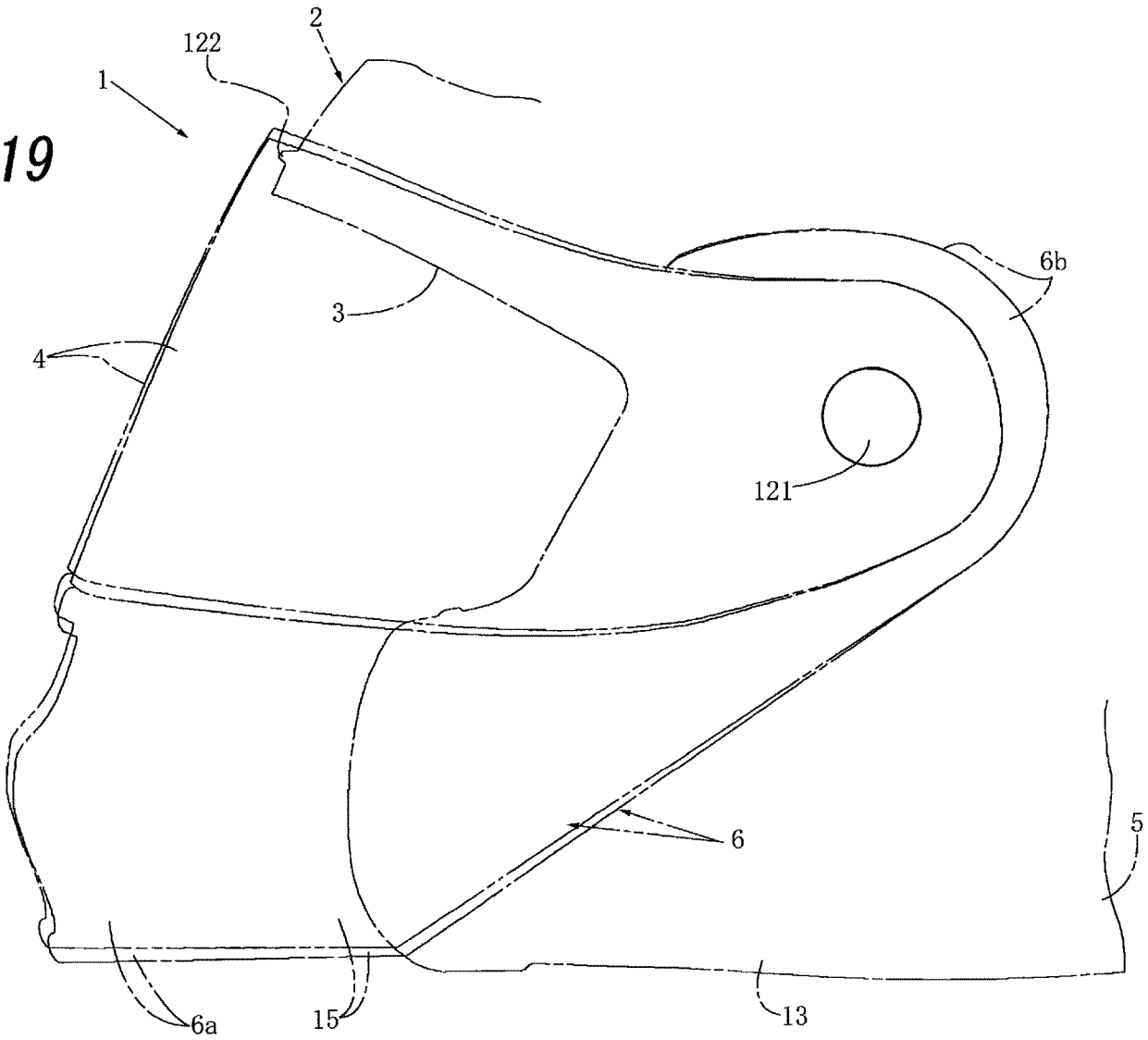
FIG. 19 is a partial left side view showing the helmet whose chin guard has pivoted by 1° from the lowermost state in the rising direction and illustrating one reference example in which the pivot support of the chin guard of the helmet shown in FIG. 13 is assumed to be set at a fixed position.

FIG. 19 illustrates one reference example in which an attachment shaft 121 that is the pivot of the chin guard 6 of the helmet 1 shown in FIG. 13 is assumed to be set at a fixed position. FIG. 19 shows a state in which the chin guard 6 has been manually made to pivot by 1° from the lowermost state in the rising direction. Note that when the chin guard 6 pivots by 1°, the shield plate 4 also pivots by 1° in the rising direction, accompanied by the chin guard 6. In this case, the shield plate 4 simply pivots in the rising direction, like the chin guard 6. Since especially the inner surface of the upper end of the shield plate 4 comes into contact with a rim member 122 such as rim rubber on the side of the main cap body 5 and rubs, the shield plate 4 and/or the rim member 122 is readily damaged. However, in the embodiment shown in FIG. 13 and the like, since each of the chin guard 6 and the shield plate 4 not only pivots in the rising direction but also moves forward, as described above, the damage can effectively be prevented.

(C) State in which Shield Plate 4 and Chin Guard 6 have Risen by 2°

To change the state described in (B) indicated by the alternate long and two short dashed line in FIG. 13 (in other words, the alternate long and short dashed line in FIG. 14) to the state described in (C) indicated by the alternate long and two short dashed line in FIG. 14, the chin guard 6 is further manually raised by 1°. For this reason, the opening 66 slightly pivots clockwise in FIG. 13 with respect to the shaft portion 106, as in the case described in (B). Hence, the convex followed surface portion 124 of the convex annular followed surface 111 is going to slightly disengage from the concave following surface portion 126. As a result, the shield plate 4 located at the position indicated by the alternate long and two short dashed line in FIG. 14 further moves substantially integrally with the chin guard 6, as indicated by the alternate long and short dashed line in FIG. 14. The linear movement of the shaft portion 106 relative to the opening 66 is prevented by the contacts at the three portions. For this reason, each of the chin guard 6 and the shield plate 4 rises from the position indicated by the alternate long and short dashed line in FIG. 14 to the position indicated by the alternate long and two short dashed line in FIG. 14 and also moves forward.

(D) State in which Shield Plate 4 and Chin Guard 6 have Risen by 4°

To change the state described in (C) indicated by the alternate long and two short dashed line in FIG. 14 (in other words, the alternate long and short dashed line in FIG. 15) to the state described in (D) indicated by the alternate long and two short dashed line in FIG. 15, the chin guard 6 is further manually raised by 2°. For this reason, the opening 66 slightly pivots clockwise in FIG. 14 with respect to the shaft portion 106, as in the case described in (C). Hence, the convex followed surface portion 124 is going to further slightly disengage from the concave following surface portion 126. Hence, the shield plate 4 located at the position indicated by the alternate long and short dashed line in FIG. 15 further moves substantially integrally with the chin guard 6, as indicated by the alternate long and two short dashed line in FIG. 15. The linear movement of the shaft portion 106 relative to the opening 66 is prevented by the contacts at the three portions. For this reason, each of the chin guard 6 and the shield plate 4 rises from the position indicated by the alternate long and short dashed line in FIG. 15 to the position indicated by the alternate long and two short dashed line in FIG. 15, and also moves forward.

(E) State in which Shield Plate 4 and Chin Guard 6 have Risen by 8°

To change the state described in (D) indicated by the alternate long and two short dashed line in FIG. 15 (in other words, the alternate long and short dashed line in FIG. 16) to the state described in (E) indicated by the alternate long and two short dashed line in FIG. 16, the chin guard 6 is further manually raised by 4°. For this reason, the opening 66 pivots clockwise in FIG. 15 to some extent with respect to the shaft portion 106, as in the case described in (D). Hence, the substantially whole convex followed surface portion 124 is going to disengage from the concave following surface portion 126. Hence, the shield plate 4 located at the position indicated by the alternate long and short dashed line in FIG. 16 further moves substantially integrally with the chin guard 6, as indicated by the alternate long and two short dashed line in FIG. 16. The linear movement of the shaft portion 106 relative to the opening 66 is prevented by the contacts at the three portions. For this reason, each of the chin guard 6 and the shield plate 4 rises from the position indicated by the alternate long and short dashed line in FIG. 16 to the position indicated by the alternate long and two short dashed line in FIG. 16, and also moves forward.

(F) State in which Shield Plate 4 and Chin Guard 6 have Risen by 16°

To change the state described in (E) indicated by the alternate long and two short dashed line in FIG. 16 to the state described in (F) indicated by the alternate long and two short dashed line in FIG. 17, the chin guard 6 is further manually raised by 8°. For this reason, the opening 66 pivots clockwise in FIG. 16 to some extent with respect to the shaft portion 106, as in the case described in (E). Hence, the entire convex followed surface portion 124 wholly disengages relatively from the concave following surface portion 126 and comes into contact with a following surface main body portion 128 having a substantially circular shape. Hence, the shield plate 4 located at the position indicated by the alternate long and two short dashed line in FIG. 16 moves substantially integrally with the chin guard 6, as indicated by the alternate long and two short dashed line in FIG. 17. The linear movement of the shaft portion 106 relative to the opening 66 is prevented by the contacts at the three portions. For this reason, each of the chin guard 6 and the shield plate 4 rises from the position indicated by the alternate long and two short dashed line in FIG. 16 to the position indicated by the alternate long and two short dashed line in FIG. 17, and also moves forward.

(G) State in which Shield Plate 4 and Chin Guard 6 have Risen by 80°

To change the state described in (F) indicated by the alternate long and two short dashed line in FIG. 17 to the state described in (G) indicated by the alternate long and two short dashed line in FIG. 18, the chin guard 6 is further manually raised by 64°. For this reason, the opening 66 largely pivots clockwise in FIG. 17 with respect to the shaft portion 106, as in the case described in (F). Hence, the convex followed surface portion 124 relatively moves counterclockwise in FIG. 17 along the following surface main body portion 128 having a substantially circular shape. Hence, the shield plate 4 located at the position indicated by the alternate long and two short dashed line in FIG. 17 moves substantially integrally with the chin guard 6, as indicated by the alternate long and two short dashed line in FIG. 18. The linear movement of the shaft portion 106 relative to the opening 66 is prevented by the contacts at the three portions. For this reason, each of the chin guard 6 and the shield plate 4 rises from the position indicated by the alternate long and two short dashed line in FIG. 17 to the position indicated by the alternate long and two short dashed line in FIG. 18 without substantially moving forward. Note that the position indicated by the alternate long and two short dashed line in FIG. 18 is the uppermost position for each of the chin guard 6 and the shield plate 4. In this case, the rise of the chin guard 6 from the uppermost position is prevented as the tubular projection 33 of the shield base 24 climbs over the triangular prism-shaped projection 35 of the support plate 21 and then abuts against the stopper projection 36. When the shield plate 4 has come to the uppermost position, further rise of the shield plate 4 is prevented as abutting portion 114 of the shield plate 4 abuts against the stopper surface 113 of the shaft member 27 with washer.

(H) State in which Chin Guard 6 is at Lowermost Position, and Only Shield Plate 4 has Risen by 48°

In the state described in (H), the chin guard 6 is held at the lowermost position shown in FIG. 12, as in the case described in (A). When the shield plate 4 is raised from the position indicated by the solid line in FIG. 11 and the alternate long and short dashed line in FIG. 13 to the position indicated by the solid line in FIG. 12, the shield plate 4 comes to the uppermost position when the chin guard 6 is held at the lowermost position shown in FIG. 12. In this case, the first and second engaged pawls 85 and 86 of the shield plate 4 are guided by the first and second engaging pawls 87 and 88 of the pivot member main body 75 of the shield pivot member 25 and the engaging pawl 82 of the unlock operation member 76. In addition, since the following projection 105 of the shield plate 4 moves upward from the lower side along the convex followed surface 71 of the shield base 24, the shield plate 4 not only simply rises but also slightly moves forward. This prevents the inner surface of the shield plate 4 from unnecessarily contacting the outer surface of the main cap body 5. When the shield plate 4 has risen by 48° to the up position while keeping the chin guard 6 held at the lowermost position, further rise of the shield plate 4 is prevented by a first abutment in which a stopped front end portion 86*a* serving as a first stopped portion of the second engaged pawl 86 of the shield plate 4 abuts against the first stopper surface 109 serving as the first stopper portion of the unlock operation member 76. When the shield plate 4 has risen by 48° to the up position, as described above, further rise of the shield plate 4 is also prevented by a second abutment in which a stopped front end face 110 serving as the first stopped portion of the second guided projecting wall 92*b* of the shield plate 4 abuts against the second stopper surface 79 serving as a first stopper portion. In this case, the shield plate 4 can be configured such that its rise is prevented mainly by at least one (for example, the first abutment) of the first abutment and the second abutment. Note that when the shield plate 4 is detached by moving the unlock operation member 76 forward, the first stopper surface 109 moves forward to a position not to abut against the stopped front end portion 86*a*.

The pivot angle (in other words, the second predetermined angle) of the chin guard 6 from the lowermost position to the uppermost position is 80°, as shown in FIGS. 2, 4, and 18. The pivot angle (in other words, the first predetermined angle) of the shield plate 4 to the uppermost position when only the shield plate 4 pivots from the lowermost position while keeping the chin guard 6 held at the lowermost position is 48°, as shown in FIG. 12. Hence, if the chin guard 6 pivots to the uppermost position while keeping the shield plate 4 held at the uppermost position, the shield plate 4 may pivot by 128° from the lowermost position. However, since the abutting portion 114 of the shield plate 4 abuts against the stopper surface 113 of the shaft member 27 with washer, as described above, the uppermost position of the shield plate 4 is regulated to the position raised by 80° from the lowermost position. For this reason, even when the chin guard 6 is raised while keeping the shield plate 4 raised, the uppermost position of the shield plate 4 is substantially the same as the uppermost position when the chin guard 6 and the shield plate 4 are raised integrally. That is, let $\alpha$ be the pivot angle of the chin guard 6 from the lowermost position to the uppermost position. When $\alpha$ ranges from 0° to 32°, the maximum value of the pivot angle of the shield plate 4 from the lowermost position to the uppermost position is $48°+\alpha$. When $\alpha$ ranges from 32° to 80°, the maximum value of the pivot angle of the shield plate 4 from the lowermost position to the uppermost position is 80°.

Having described a specific preferred embodiment of the present invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the above-described embodiment, the annular followed surface 111 is formed into a convex shape, and the annular following surface 65 is formed into a concave shape. However, conversely, the annular followed surface 111 may be formed into a concave shape, and the annular following surface 65 may be formed into a convex shape.

In the above-described embodiment, the concave annular following surface 65 is formed from the edge of the opening 66. However, the concave annular following surface 65 need not always be formed from the edge of the opening 66. The concave annular following surface 65 may be formed from the edge of a recess, or the edge of a concave portion partially including a recess and an opening.

In the above-described embodiment, each of the annular followed surface 111 and the annular following surface 65 is formed into a complete annular shape. However, each of the annular followed surface 111 and the annular following surface 65 need only be formed into a substantially annular shape as long as the contacts at the three portions are satisfactorily done. "The annular following surface 65 follows the annular followed surface 111" in the text means that the annular following surface 65 formed into a substantially annular shape substantially moves (for example, substantially pivots) in partial contact with the annular followed surface 111 formed into a substantially annular shape while keeping the same contact relationship as that of a cam follower and a cam. Hence, the combination of the following surface 65 or 105 and the followed surface 111 or 71 is substantially the same as the relationship of a cam follower and a cam.

In the above-described embodiment, the pivot angle (in other words, the second predetermined angle) of each of the shield plate 4 and the chin guard 6 from the lowermost position to the uppermost position is 80°. However, the pivot angle need not always be 80°. Each pivot angle preferably ranges from 60° to 100° from the viewpoint of practicality, and more preferably ranges from 70° to 90°. The shield plate 4 and the chin guard 6 need not always have a substantially same pivot angle each other.

In the above-described embodiment, the pivot angle (in other words, the first predetermined angle) of the shield plate 4 to the uppermost position when only the shield plate 4 pivots from the lowermost position while keeping the chin guard 6 held at the lowermost position is 48°. However, the pivot angle need not always be 48°. The pivot angle preferably ranges from 36° to 60° and more preferably ranges from 40° to 56°, from the viewpoint of practicality.

The invention claimed is:

1. A helmet having a front, a rear, a left side, and a right side including left and right chin guard support mechanisms provided on a main cap body at the left side and the right side of the helmet, and a chin guard provided at least partially at the front of the helmet and whose regions including left and right ends and vicinities thereof are pivotally attached to said left and right chin guard support mechanisms, respectively, each of said left and right chin guard support mechanisms including a first fixed side member fixed to said main cap body, and a first moving-side member fixed to said chin guard, wherein each of said left and right chin guard support mechanisms further includes a second fixed-side member fixed to said first fixed-side member, a convex annular followed surface is provided on said second fixed-side member, said convex annular followed surface comprises a followed surface main body portion having a substantially circular shape, and first and second convex followed surface portions protruding outward from said followed surface main body portion to face each other, a concave annular following surface capable of pivoting forward and backward while following said convex annular followed surface is provided on said first moving-side member, said concave annular following surface comprises a first concave following surface portion arranged to fit on, engage with, or contact said first convex followed surface portion and having a protrusion substantially corresponding to said first convex followed portion; a second concave following surface portion arranged to contact said second convex followed surface portion and configured to be substantially longer in the circumferential direction than said second convex followed surface portion; and a following surface portion having a bent shape which protrudes towards the followed surface main body portion of the convex annular followed surface of said second fixed-side member, and arranged between said first and second concave following surface portions such that it can be in contact with said followed surface main body portion having a substantially circular shape, wherein the first concave following surface portion, the second concave following surface portion, and the following surface portion having the bent shape are continuously connected such that they form a portion of a closed loop, wherein said chin guard is configured to rise while moving forward with respect to said main cap body by moving said concave annular following surface forward while following each of said followed surface main body portion having a substantially circular shape and said first and second convex followed surface portions of said convex annular followed surface as the chin guard pivots from a lowermost position towards an uppermost position within a pivot-range of the chin guard, and wherein the concave annular following surface is an indentation which is formed directly in the chin guard and the convex annular followed surface is a single piece inside the indentation so that the convex annular followed surface is capable of performing a first movement of pivoting laterally in a forward or backward direction with respect to the convex annular followed surface and the main cap body while simultaneously performing a second movement of rotating in an upward or downward direction.

2. A helmet according to claim 1, further comprising:

a shield plate whose regions including left and right ends and vicinities thereof are pivotally attached to said left and right chin guard support mechanism, respectively, wherein each of said left and right chin guard support mechanisms further includes a second moving-side member supported to be movable forward and backward with respect to said first moving-side member, a second followed surface is provided on said first moving-side member, a second following surface capable of moving forward and backward while following said second followed surface is provided on said shield plate, further comprising said second following surface in which when said shield plate pivots forward in a rising direction from a down position with respect to said chin guard, said second following surface moves forward while following said second followed surface so that said shield plate rises while moving forward, and further comprising:

a first stopper portion provided on said second moving-side member, and a first stopped portion provided on said shield plate to be able to abut against said first stopper portion;

a second stopper portion provided on said first fixed-side member, and a second stopped portion provided on said first moving-side member; and a third stopper portion provided on said second fixed-side member, and a third stopped portion provided on said shield plate, further comprising said first stopper portion in which when said shield plate rises by a first predetermined angle with respect to said chin guard, said first stopped portion abuts against said first stopper portion so as to prevent further rise of said shield plate, further comprising said second stopper portion in which when said chin guard rises by a second predetermined angle larger than said first predetermined angle with respect to said main cap body, said second stopped portion abuts against said second stopper portion so as to prevent further rise of said chin guard, and further comprising said third stopper portion in which when said shield plate substantially rises by said second predetermined angle with respect to said main cap body, said third stopped portion abuts against said third stopper portion so as to prevent further rise of said shield plate.

3. A helmet according to claim 2, wherein the first predetermined angle ranges from 30° to 60°.

4. A helmet according to claim 2, wherein the first predetermined angle ranges from 40° to 56°.

5. A helmet according to claim 2, wherein the second predetermined angle ranges from 60° to 100°.

6. A helmet according to claim 2, wherein the second predetermined angle ranges from 70° to 90°.

7. A helmet according to claim 1, wherein said concave annular following surface substantially always contacts said convex annular followed surface at three portions spaced apart from each other independently of a forward and backward pivot position of said first moving-side member with respect to said second fixed-side member, and contacting at the three portions prevents an unnecessary linear forward and backward movement of said first moving-side member with respect to said second fixed-side member.

8. A helmet according to claim 7, wherein the contacts at the three portions include:

(i) a contact between a peripheral surface of the first convex followed surface portion of said convex annular followed surface and, out of said concave annular following surface, a region including a peripheral surface of a first concave following surface portion having a substantially same shape as said first convex followed surface portion and a vicinity thereof:

(ii) a contact between a peripheral surface of the second convex followed surface portion of said convex annular followed surface and, out of said concave annular following surface, a region including a peripheral surface of the second concave following surface portion longer than said second convex followed surface portion in a circumferential direction and a vicinity thereof; and (iii) a contact between a peripheral surface of the followed surface main body portion having a substantially circular shape between said first convex followed surface portion and said second convex followed surface portion out of said convex annular followed surface, and a peripheral surface of a following surface portion having a bent shape of said concave annular following surface.

9. A helmet according to claim 8, wherein said concave annular following surface is formed from an edge of an opening formed in said first moving-side member.

* * * * *